United States Patent [19]

Kuge et al.

[11] 4,456,825

[45] Jun. 26, 1984

[54] METHOD OF AND DEVICE FOR CHARGING BY CORONA DISCHARGE

[75] Inventors: Tsukasa Kuge; Koichi Tanigawa, both of Tokyo; Tsuyoshi Watanabe, Kawasaki, all of Japan

[73] Assignee: Canon Kabushiki Kaisha, Tokyo, Japan

[21] Appl. No.: 413,495

[22] Filed: Aug. 26, 1982

Related U.S. Application Data

[63] Continuation of Ser. No. 174,835, Aug. 4, 1980, abandoned, which is a continuation of Ser. No. 1,204, Jan. 5, 1979, abandoned, and Ser. No. 798,040, May 18, 1977, abandoned.

[30] Foreign Application Priority Data

| | | | |
|---|---|---|---|
| May 26, 1976 | [JP] | Japan | 51-60778 |
| Jul. 30, 1976 | [JP] | Japan | 51-91837 |
| Jul. 30, 1976 | [JP] | Japan | 51-91838 |
| Jul. 31, 1976 | [JP] | Japan | 51-91938 |
| Oct. 18, 1976 | [JP] | Japan | 51-124544 |

[51] Int. Cl.[3] ..... H01T 19/24

[52] U.S. Cl. ..... 250/324; 250/325

[58] Field of Search ..... 250/324, 325, 326

[56] References Cited

U.S. PATENT DOCUMENTS

| | | | |
|---|---|---|---|
| 3,062,956 | 11/1962 | Codichini | 250/326 |
| 3,604,925 | 9/1971 | Snelling | 250/324 |
| 3,742,237 | 6/1973 | Parker | 250/324 |
| 3,909,614 | 9/1975 | Marshall | 250/324 |
| 3,961,193 | 6/1976 | Hudson | 250/324 |

*Primary Examiner*—Bruce C. Anderson

*Attorney, Agent, or Firm*—Fitzpatrick, Cella, Harper & Scinto

[57] ABSTRACT

In charging a surface of a chargeable member by AC corona discharge, the current difference between the plus and the minus component of the AC corona discharge current is detected, and the current difference is maintained constant to thereby stably produce a constant surface potential on the chargeable member.

13 Claims, 41 Drawing Figures

METHOD OF AND DEVICE FOR CHARGING BY CORONA DISCHARGE

This is a continuation of application Ser. No. 174,835, filed Aug. 4, 1980, abandoned which in turn is a continuation of Ser. Nos. 1,204 & 798,040, filed Jan. 5, 1979 & May 18, 1977, respectively, all now being abandoned.

BACKGROUND OF THE INVENTION

1. Field of the Invention

This invention relates to a method of and a device for charging by the use of corona discharge. Charging by the use of corona discharge will hereinafter be described with electrophotography as an example. The electrophotographic processes generally include a method whereby charge of the positive or the negative polarity is applied to a two-layer photosensitive medium comprising a photoconductive layer and a conductive base and subsequently the photosensitive medium is exposed to image light to form thereon an electrostatic latent image which is in turn subjected to the developing step to provide a visible image, and a method whereby primary charge of the positive or the negative polarity is imparted to a three-layer photosensitive medium comprising a transparent insulating layer, a photoconductive layer and a conductive base and subsequently image light and secondary charge are applied to the photosensitive medium to remove the primary charge and form an electrostatic latent image thereon, whereafter the photosensitive medium is subjected to whole surface exposure to increase the contrast of the latent image, which is then subjected to the developing step to provide a visible image. This latter process is shown in FIG. 1 of the accompanying drawings, wherein reference character 1 designates a photosensitive medium rotatable in the direction of the arrow, 2 a primary charger, 3 an image light, 4 a secondary charger, 5 a light source for whole surface exposure, 6 a developing device, 7 an image transfer charger for facilitating the image transfer to transfer paper 8, and 9 designates a cleaning device. The charging used in these electrophotographic processes utilizes the DC corona discharge or the AC corona discharge and it is known, for example, that the DC corona discharge is utilized for the primary charger 2 and the image transfer charger 7 and the AC corona discharge is utilized for the secondary charger.

2. Description to the Prior Art

An example of the charger according to the prior art is illustrated in FIG. 2(*a*), wherein reference numeral 21 designates a high voltage source, 22 a corona discharge wire and 1 a photosensitive medium. The high voltage source 21 may be either an AC voltage source or a DC voltage source, and a voltage greater than the corona discharge start voltage VC may be applied therefrom to the corona discharge wire 22 to produce a corona discharge current which may impart charge to the surface of the photosensitive medium.

An important point in electrophotography or the like is that a constant surface potential should be stably provided to ensure good reproducibility of the electrostatic latent image this produced. Corona charge greatly affects the electrostatic latent image and therefore, in order to stabilize the surface potential, it is necessary in the charger of FIG. 2(*a*) that various factors, such as the relative moving velocity of the photosensitive medium and the corona discharger, the width of the opening of the corona discharger (formed by the shield 22S), the distance between the corona discharge wire and the photosensitive medium, atmospheric conditions such as temperature, humidity, etc., and the voltage applied be constant at all times.

FIGS. 2(*b*) to 2(*d*) show conventional chargers designed to reduce the variation in surface potential which may result from changes of the above-mentioned factors. In FIG. 2(*b*), a resistor 24 is serially inserted in the high voltage output side of the voltage source 21; in FIG. 2(*c*), the output of the voltage source may be divided by rectifiers 26-1 and 26-2 while a resistor 24 is inserted and connected to the corona wire 22; in FIG. 2(*d*), a constant voltage discharge tube 25 is employed instead of the resistor 24. In any of these, the change in corona discharge resistance resulting from the change in atmospheric conditions or from the irregularity of the distance between the corona discharge wire and the surface of the photosensitive medium could not sufficiently be compensated for and thus, the stability of the resultant surface potential and of the finally obtained visible image has been unsatisfactory. For example, the change of atmospheric conditions from normal temperature and humidity to high temperature and humidity led to an unfavorable result in that the developed visible image was fogged.

SUMMARY OF THE INVENTION

It is an object of the present invention to provide a method of and a device for charging which ensures that a substantially invariable surface potential is produced even when changes occur in atmospheric conditions such as temperature and humidity.

It is another object of the present invention to provide a method of and a device for charging which substantially eliminates the necessity of adjusting the distance between the corona discharge wire and the surface of the photosensitive medium.

It is still another object of the present invention to provide a method of and a device for corona charging in which charging may be substantially effected by a constant current or a constant voltage.

It is still another object of the present invention to provide a method of and a device for charging in which the effect of the control of the surface potential on the photosensitive medium by a grid is much higher than the charging method using the conventional grid.

It is a further object of the present invention to provide a method of and a device for corona charging which may charge with a stable surface potential irrespective of a small discharge current.

It is a further object of the present invention to provide an electrophotographic method which may ensure very stable image formation against any change in corona discharge resistance resulting from the change in atmospheric conditions such as temperature, humidity, etc.

It is a further object of the present invention to provide an electrophotographic method which may essentially increase the potential difference of the photosensitive medium corresponding to the light and dark regions of an image to be reproduced.

The above objects and other features of the present invention will become more fully apparent from the following detailed description of the invention taken in conjunction with the accompanying drawings.

BRIEF DESCRIPTION OF THE DRAWING

FIG. 5(*b*) is a graph illustrating the I-R characteristic in FIG. 4.

FIG. 7(*b*) is a graph illustrating the I-R characteristic in FIG. 6.

FIG. 9(*b*) is a graph illustrating the I-R characteristic in FIG. 8.

DESCRIPTION OF THE PREFERRED EMBODIMENT

This invention was born by paying attention to the corona discharge current resulting from AC corona discharge and also by paying attention not to the total corona discharge current $I_T$ but to the current difference $\Delta I$ between the plus component $I_{\oplus}$ and the minus component $I_{\ominus}$ forming the total current. That is, in DC corona discharge, the total corona discharge current determines the surface potential of a photosensitive medium while, in AC corona discharge, the current difference $\Delta I = I_{\oplus} - I_{\ominus}$, instead of the total current, determines the charging inclination and the surface potential of the photosensitive medium. In other words, when $\Delta I = 0$ irrespective of the magnitude of the total current of corona discharge $I_T = I\oplus + I_{\ominus}$, the surface potential of a photosensitive medium or the like is not affected by AC corona discharge (zero charging inclination); when $\alpha I > 0$, the surface potential of the photosensitive medium or the like is changed toward the positive in accordance with the magnitude of $\Delta I$ by AC corona discharge (positive charging inclination); and when $\Delta I < 0$, the surface potential of the photosensitive medium or the like is changed toward the negative in accordance with the magnitude of $\Delta I$ by AC corona discharge (negative charging inclination).

Figure 3:
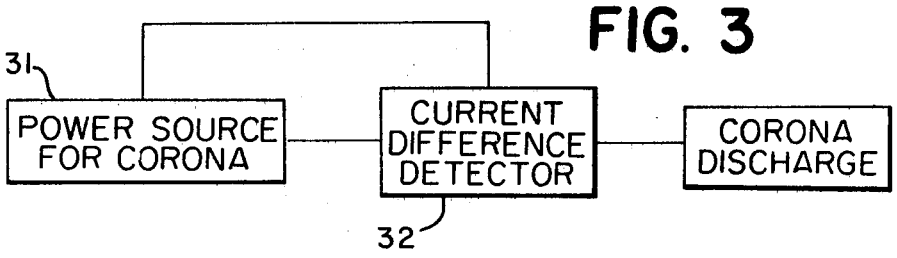
FIG. 3 illustrates the principle of the charging method and device according to the present invention.

A feature of the present invention is in that the current difference $\Delta I$ of the AC corona discharge current is maintained constant in such a charging method, whereby a constant surface potential may be stably provided on a chargeable member such as photosensitive medium or insulating paper. Another feature of the present invention is that, as shown in FIG. 3, a current difference detector 32 utilizing the detection of DC component or of the difference between the components of AC is provided to detect the current difference $\Delta I$ of AC corona discharge and the output of a power source 31 is controlled in accordance with the change in the detection value so as to maintain $\Delta I$ at a preset value.

Figure 4A:
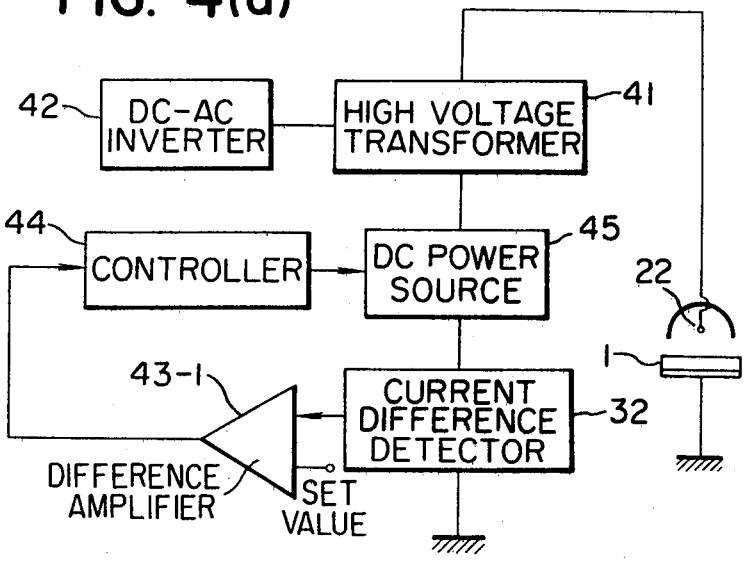
FIG. 4 more particularly illustrates the basic principle of the charging method and device according to the present invention.
Figure 4B:
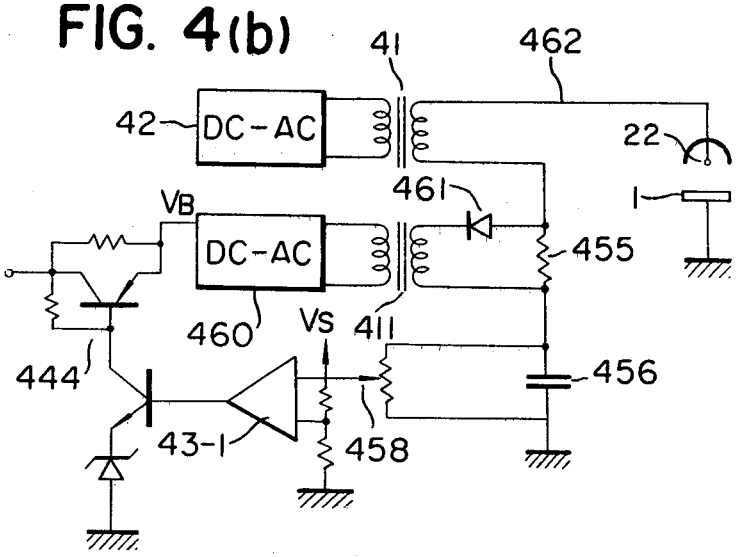

FIG. 4 shows a diagram of the circuit for the charging according to the present invention. The circuit includes an AC transformer 41, a DC-AC inverter 42, a difference amplifier 43-1, a DC controller 44 and a DC voltage source 45.

Figure 5A:
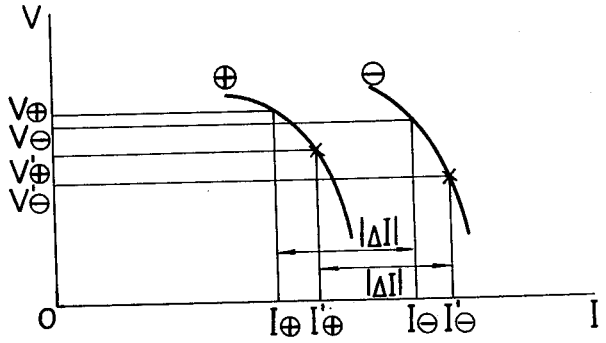
FIG. 5(*a*) is a graph illustrating the V-I characteristic in FIG. 4.
Figure 5B:
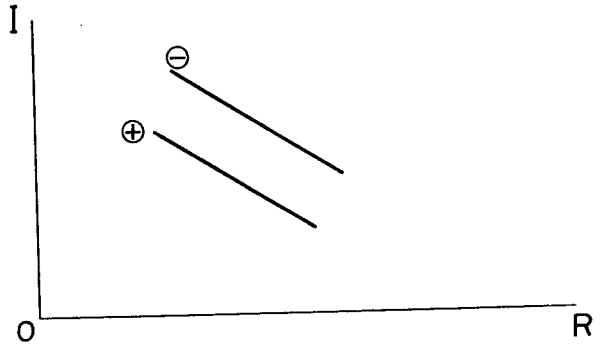

When AC corona discharge takes place, the current difference $\Delta I$ of the high voltage output is detected as DC component by the current difference detector 32 and if the detected current difference differs from a predetermined value $\Delta I_S$, feedback is effected so that the output from the DC power source is varied to maintain the current difference $\Delta I$ at the predetermined value. Therefore, by presetting the DC controller 44 so that $\Delta I = 0$, the AC corona discharge having the zero charging inclination may be stabilized and by presetting the DC controller 44 so that $\Delta I<0$, the AC corona discharge having the negative charging inclination may be provided to maintain the surface potential stable. A charging method using the AC corona discharge having the negative charging inclination will hereinafter be illustratively shown, but of course this charging inclination is not restrictive. The V-I characteristic of the high voltage output controlled so that such a particular charging inclination may be set up and that the current difference $\Delta I$ may be maintained constant to stabilize the charging inclination is illustrated in FIG. 5(*a*) with respect to each of the component currents. In FIG. 5(*a*), the dots (.) correspond to the AC corona discharge in an atmosphere of normal temperature and humidity, $V_{\oplus}$ and $V_{\ominus}$ signify the plus and minus component of the output voltage under such atmospheric conditions and $I_{\oplus}$ and $I_{\ominus}$ signify the plus and the minus component of the output current under such atmospheric conditions. The points indicated by "X" correspond to the AC corona discharge in an atmosphere of high temperature and humidity, $V_{61}'$ and $V_{\ominus}'$ signify the plus and the minus component of the output voltage under such atmospheric conditions, and $I_{\oplus}'$ and $I_{\ominus}'$ signify the plus and the minus component of the output current under such atmospheric conditions.

FIG. 5(*b*) illustrates the I-R characteristic of said controlled high output voltage for the change in load R, with respect to each of the component currents. It is seen that the voltage applied to the AC corona wire and the quantity of each component current are changed by the change in the corona discharge resistance resulting from the change in atmospheric conditions but the current difference $\Delta I$ is maintained constant, so that a stable surface potential can be produced.

Figure 6:
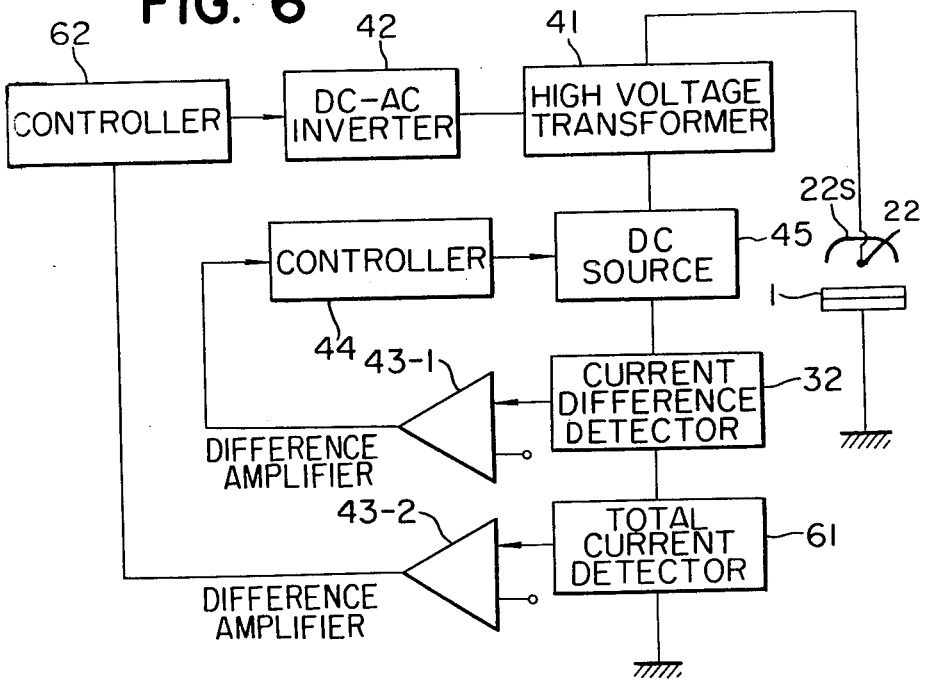
FIG. 6 shows a derivative form of the charging method and device according to the present invention.

FIG. 6 shows an arrangement in which a total current detector 61 is provided in addition to the elements of FIG. 4, so that it may detect the AC current also and checks whether it is at a predetermined value. If the detected AC current differs from the predetermined value, the output of the DC-AC inverter 42 is controlled by an AC controller 62 to render the total output current constant.

Figure 7A:
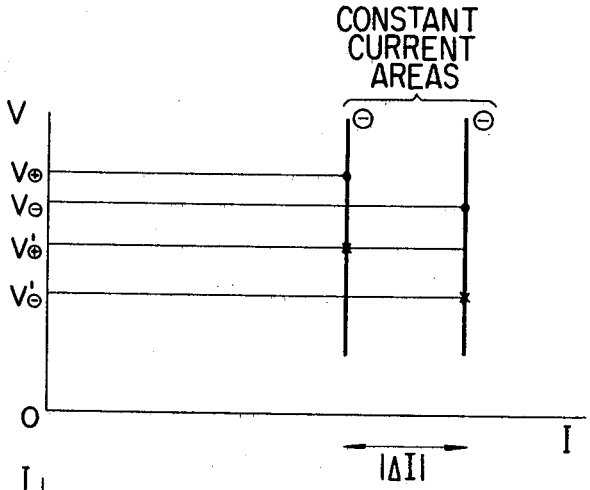
FIG. 7(*a*) is a graph illustrating the V-I characteristic in FIG. 6.
Figure 7:
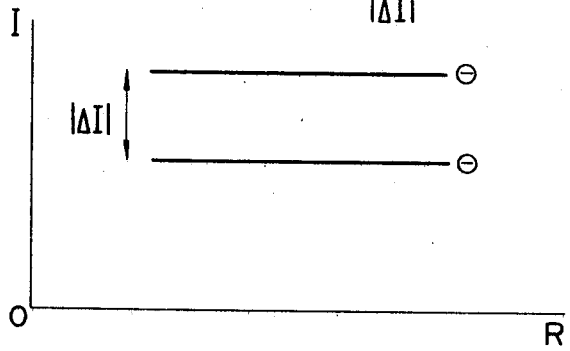

FIGS 7(*a*) and 7(*b*) illustrate the characteristics in FIG. 6 and the reference characters therein correspond to those in FIGS. 5(*a*) and 5(*b*). By such characteristics, the current differences $\Delta I$ of the corona discharge is maintained constant and the total current is also rendered constant, so that not only a stable surface potential can be provided but also the current which would otherwise flow outwardly in a great quantity can be suppressed even in such a situation wherein spark discharge takes place to short circuit the high voltage output, thereby preventing damage of the corona wire and/or the photosensitive medium which would otherwise result from the continuance of the spark discharge.

Figure 8:
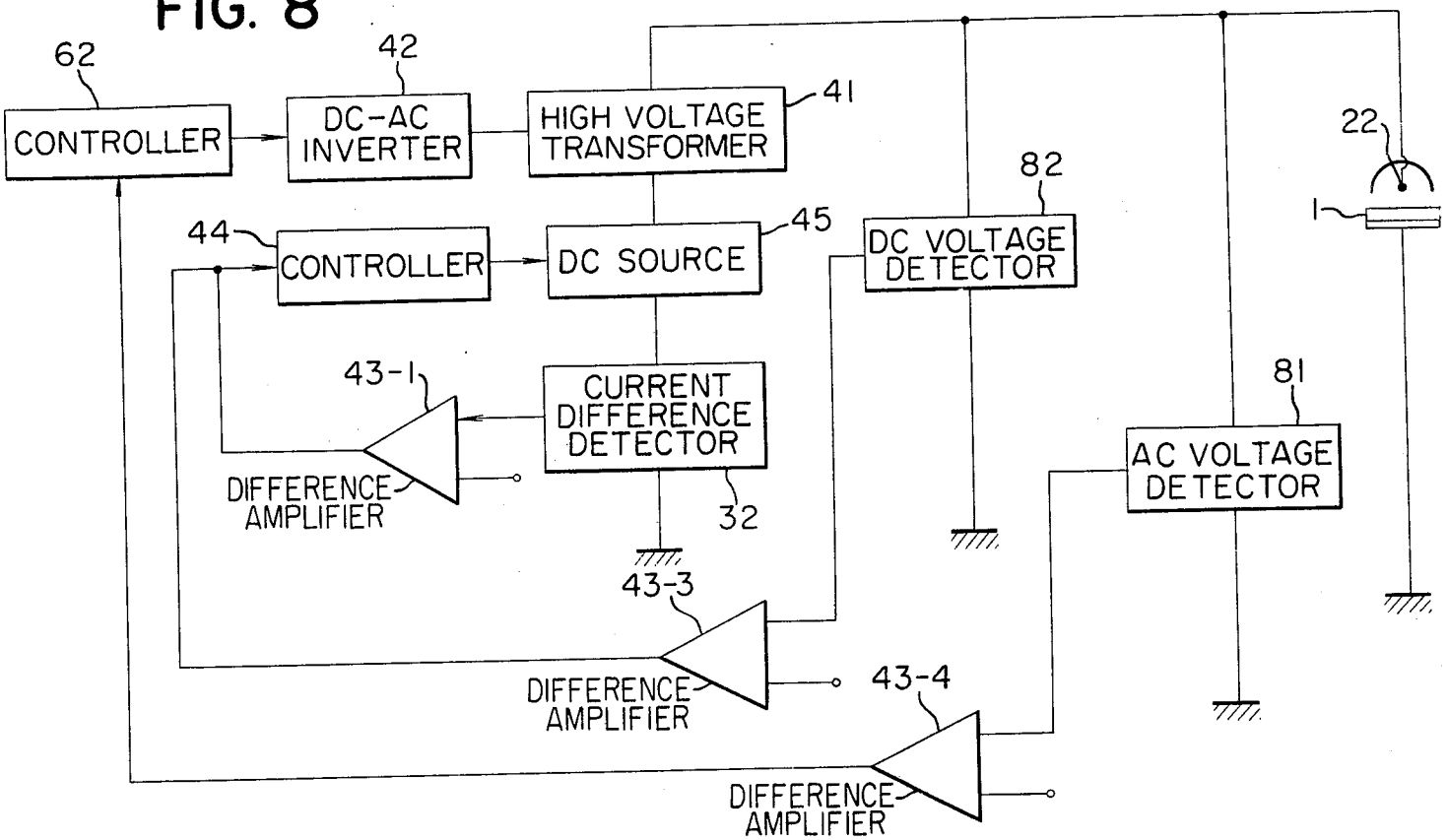
FIG. 8 shows another derivative form of the present invention.

FIG. 8 shows a circuit arrangement in which an AC voltage detector 81 and a DC voltage detector 82 are provided in addition to the elements of FIG. 4, to detect the output voltage also and the output voltage is controlled by the AC controller 62 and the DC controller 44 in accordance with the change in the detected voltages, whereby there may be provided a high voltage output which is constant and which has a constant current difference.

Figure 9A:
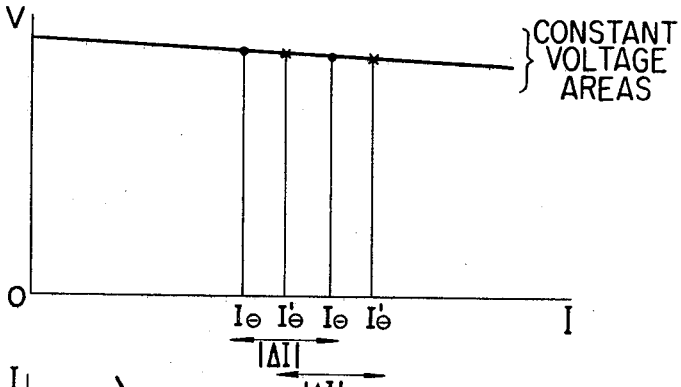
FIG. 9(*a*) is a graph illustrating the V-I characteristic in FIG. 8.
Figure 9B:
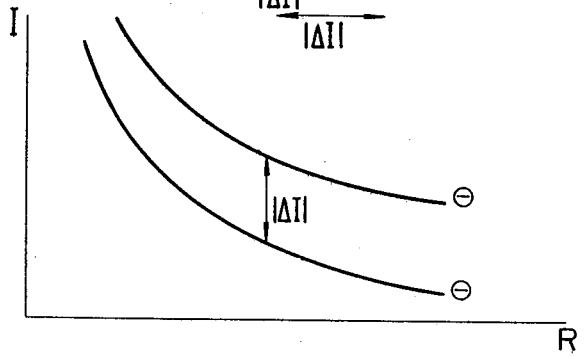

The V-I and the I-R characteristic in this instance are illustrated in FIGS. 9(*a*) and 9(*b*), respectively. Reference characters in FIGS. 9(*a*) and 9(*b*) are similar to those in FIGS. 5(*a*) and 5(*b*). By this, the current difference $\Delta I$ resulting from corona discharge is maintained constant and the voltage V applied to the corona wire is also maintained substantially constant. This is an improvement over the disadvantage which was unavoidable in corona discharge, namely, that the effort to make the corona current constant necessitated of varying the corona voltage in accordance with the change in discharge resistance. Consequently, there is provided of substantial coexistence of constant voltage and constant current, which in turn leads to the production of a surface potential or an electrostatic latent image which is stable against the change in corona discharge resistance resulting from the change in atmospheric conditions and the change in the distance between the corona discharge wire and the surface of the photosensitive medium.

Figure 10:
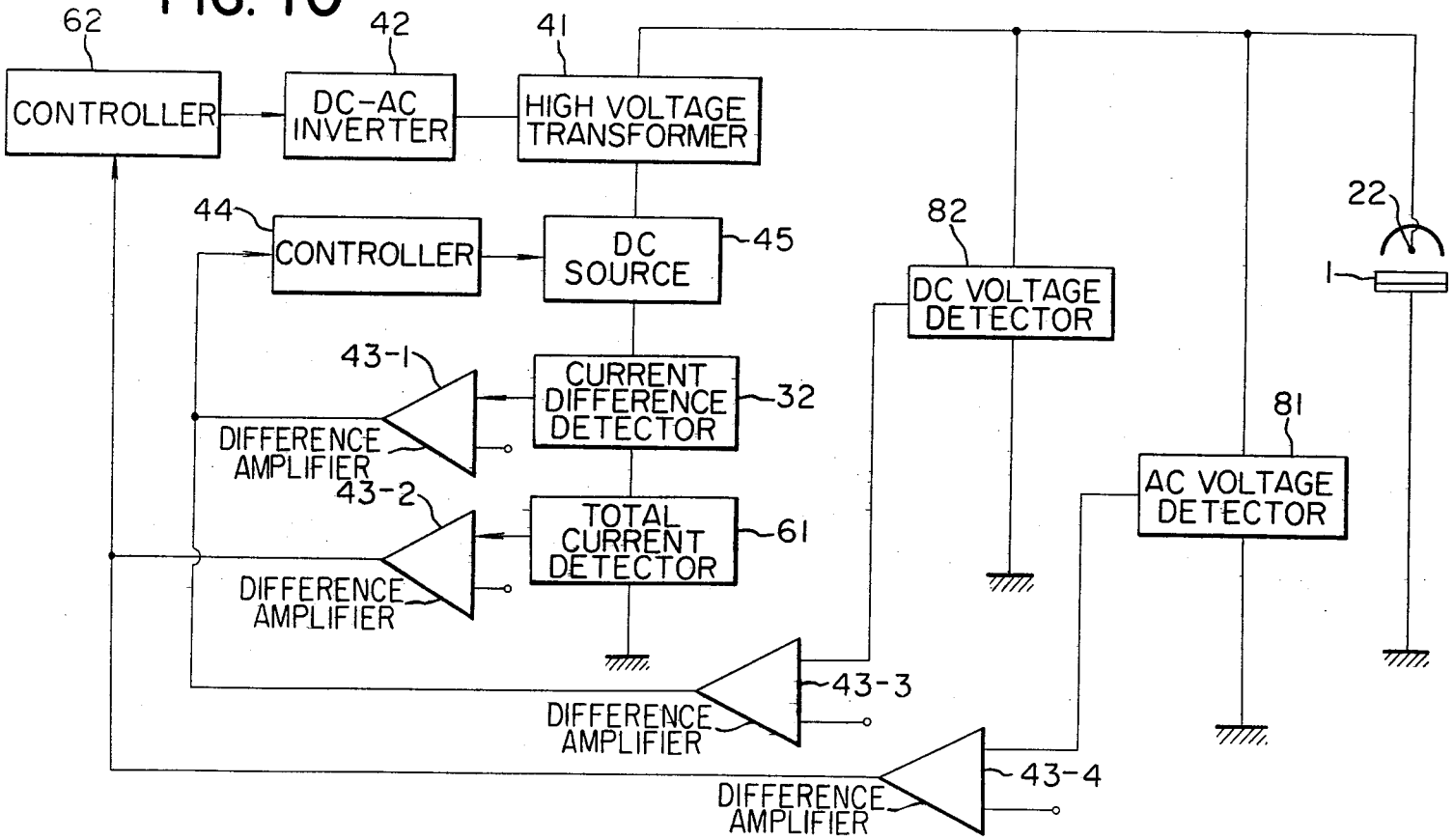
FIG. 10 shows still another derivative form of the present invention.

FIG. 10 shows a circuit arrangement in which an AC controller 62 is provided in addition to the elements of FIG. 8 and operated by the total current detector 61 so as to control the total current, thereby preventing any over-current which would otherwise result from spark discharge or short-circuiting.

FIG. 4(*b*) shows a specific example of the circuit according to the present invention, in which reference character 42 designates a DC-AC inverter of about 100 Hz which inverts a DC voltage into a high AC voltage through a transformer 41. Designated by 460 is also a DC-AC inverter which rectifies an AC voltage into a high DC voltage through a transformer 411 and a diode 461 and superimposes such DC voltage upon said high AC voltage through a resistor 455. Denoted by 456 is a capacitor for detecting the current difference and for storing therein the difference between the charge flowing through a line 462 for ten minutes and the charge flowing through the line 462 for one minute. Consequently, the output resulting from such charge is detected by a detection resistor 458 and compared with a reference voltage and if the detected output is greater than the reference voltage, a power source control circuit 444 will be acted on to lower the source voltage VB for the inverter in accordance with that rise. By this, the output of the inverter 460 is lowered in accordance with the detection value to render constant the detection value from the capacitor 456. Alternatively, a similar effect may be provided by reducing the pulse width or the frequency of the inverter 460 in accordance with the detection value.

In the foregoing, the total current detector 61 may be one which may detect AC inductively (namely, by providing a further transformer in the line of FIG. 4(*b*) and detecting the AC from the secondary winding thereof) or which may rectify AC and detect AC+DC. The controller 62 may be well-known voltage control means which may control the DC source for DC-AC inverter 42, the DC source 45 may be a source of half wave synchronized with AC or a so-called DC source, and the controller 44 may be well-known voltage control means which may adjust the output voltage of the DC source 45.

The AC voltage detector and the DC voltage detector may be provided by providing detection windings for the transformer 41 and 411, respectively, so that voltage values may be indirectly detected from these windings.

The invention will be further described with respect to some examples of experiments, although the individual conditions in practice are not restricted to those shown in these examples.

EXAMPLE OF EXPERIMENT 1

In the charging method of FIG. 8 which incorporates the constant voltage and constant current difference control, a photosensitive medium was subjected to AC corona charge in an atmosphere of temperature 25° C. and relative humidity 60% to provide a surface potential of −500 V. Thereafter, the atmosphere was changed to temperature 37° C. and humidity 93%, but the surface potential of the photosensitive medium remained substantially at −500 V by being subjected to AC corona discharge. Thus, the charges in the atmosphere did not affect the surface potential of the photosensitive medium.

Figure 2:
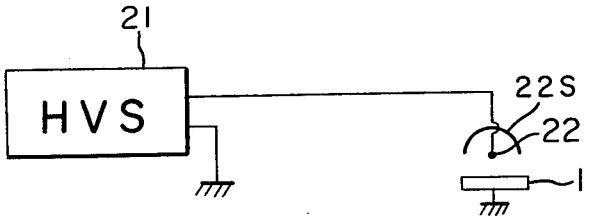
FIGS. 2(*a*) to 2(*d*) schematically illustrate the methods of corona charging according to the prior art.
Figure 2:
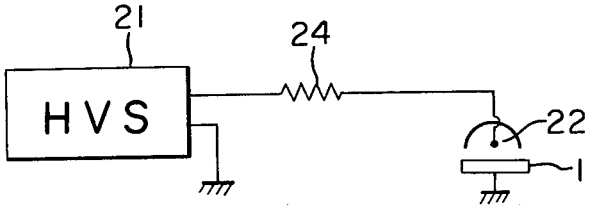
Figure 2:
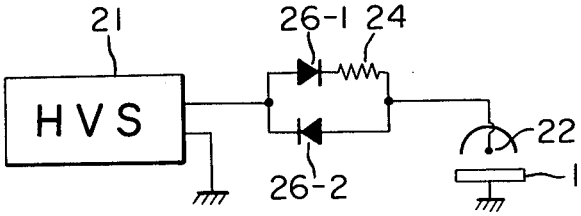
Figure 2:
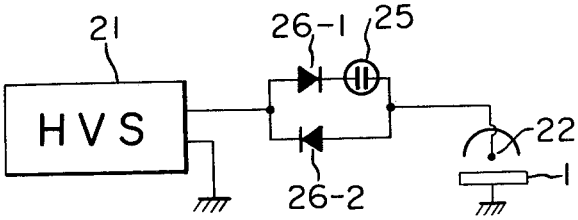

In contrast, in the charging method of FIG. 2(*a*) using the conventional constant voltage power source, the surface ptential of the photosensitive medium changed from −500 V to −100 V after having been subjected to corona charge.

EXAMPLE OF EXPERIMENT 2

In the charging method of FIG. 8 which incorporates the constant voltage and constant current difference control, a photosensitive medium was subjected to AC corona charge in an atmosphere of temperature 25° C. and relative humidity 60% to provide a surface potential of −500 V. Thereafter, the corona wire was spaced apart by 1.5 mm from the photosensitive medium, but the surface potential of the photosensitive medium after being subjected to the AC corona discharge remained substantially at −500 V.

When the same operation was carried out in the charging method of FIG. 2(*a*) using the conventional constant voltage power source, the surface potential of the photosensitive medium after subjected to the corona charge changed from −500 V to −250 V.

An example will now be shown in which the three sides of the corona discharge wire other than the opening portion thereof are formed by an insulating shield. In this instance, the charger cannot practically perform as such because corona discharge is not connected even if a DC voltage V greater than the corona discharge start voltage Vc is applied to the corona discharge wire, whereas if an AC voltage V greater than the corona discharge start voltage Vc is applied to the corona discharge wire, corona discharge is connected and sufficient charge can be imparted to a photosensitive medium. That is, when noting the current difference $\Delta I$ minus the current difference $\Delta I_S$ of the corona discharge current flowing outwardly through the shield (hereinafter referred to as the ineffective corona discharge current difference $\Delta I_S$), namely, the current difference $\Delta I_C \equiv \Delta I - \Delta I_S$ (hereinafter referred to as the effective corona discharge current difference $\Delta I_C$), it will be seen that the magnitude of the effective corona discharge current difference $\Delta I_C$ directly determines the value of the surface potential. Thus, the present invention comprises an improvement in that by providing an insulating shield and by maintaining constant the current difference between the plus and the minus component of an AC corona discharge current, the surface potential of the chargeable member can be stably obtained irrespective of the small magnitude of discharge current.

In this case, no current flows outwardly through the shield and therefore, the ineffective corona discharge current difference $\Delta I_S$ is zero, so that the intended effective corona discharge current difference $\Delta I_C$ can be obtained for a smaller corona discharge current difference $\Delta I$, namely, a smaller discharge current I, than in the case of an AC corona discharger having a conductive shield.

Figure 11:
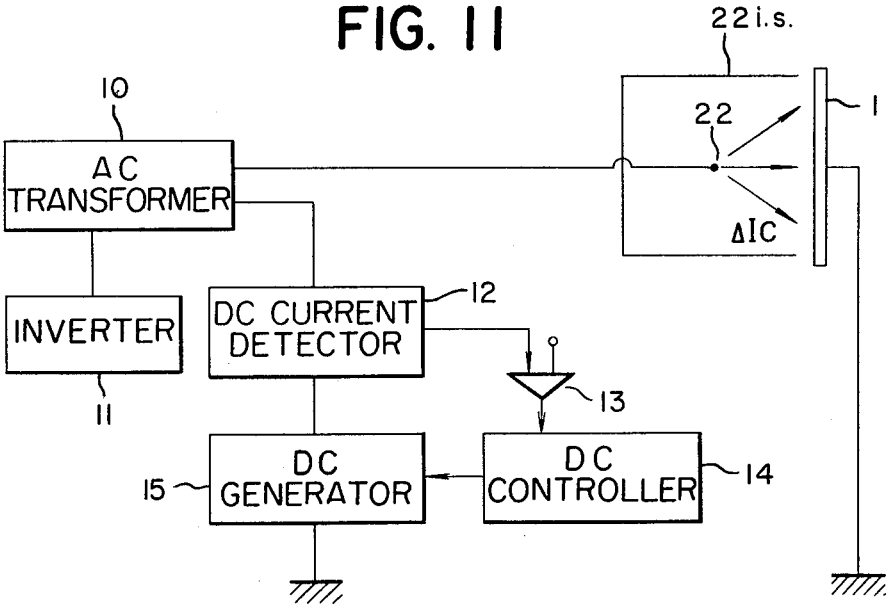
FIG. 11 shows a charger of the present invention having an insulating shield.

FIG. 11 shows a specific example of this. Designated by 22 is the corona discharge wire, 1 the photosensitive medium, and 22 is the insulating shield. The other elements, corresponding to those in the circuit of FIG. 4, include an AC transformer 10, an inverter 11, a DC current detector 12, a difference amplifier 13, a DC controller 14, and a DC generator 15. When an AC output having such a stable constant current difference is used as an aid, the AC charger of the present invention has, in addition to the above-noted advantage is, a further advantage that a constant effective corona discharge current difference $\Delta I_C(=\Delta I)$ can always be imparted to the photosensitive medium 1 even if the corona discharge resistance is changed by the irregularity of the distance between the corona discharge wire and the surface of the photosensitive medium and the change in atmospheric conditions such as temperature and humidity, whereby the surface potential can be much more stable than when the conventional charger is utilized. These two advantages, namely, the ability to make all of the current difference contribute to charging and the ability to control the stabilization of the surface potential, are highly effective.

The invention will be described with respect to further examples of experiments, although the individual conditions in practice are not restricted thereto.

EXAMPLE OF EXPERIMENT 1

In an atmosphere of temperature 25° C. and relative humidity 60%, the photosensitive medium 1 was charged by a charger having a grounded metallic shield 22s as shown in FIG. 2, with the corona discharge wire 22 disposed at a distance of 10 mm from the surface of the photosensitive medium. The voltage applied was AC 7.4 KV. The following corona current was obtained. The current values are per 10 mm of the corona discharge wire length.

| | |
|---|---|
| Corona discharge current I | AC 38.5 μA |
| Corona discharge current difference $\Delta I$ | −11.0 |
| Ineffective corona discharge current difference $\Delta I_S$ | −6.5 |
| Effective corona discharge current difference $\Delta I_C$ | −4.5 |
| $\Delta I_C/\Delta I$ | 0.41 |

Under the same charging conditions, the following result was obtained by the use of an AC corona discharger having the insulating shield 4 as shown in FIG. 11.

| | |
|---|---|
| Corona discharge current I | AC 35.0 μA |
| Corona discharge current difference $\Delta I$ | −5.9 |
| Ineffective corona discharge current difference $\Delta I_S$ | 0 |
| Effective corona discharge current difference $\Delta I_C$ | −5.9 |
| $\Delta I_C/\Delta I$ | 1.0 |

In this manner, the AC corona discharger of FIG. 11 enables the corona discharge current difference $\Delta I$ to be utilized more efficiently than the conventional charger.

EXAMPLE OF EXPERIMENT 2

By the use of the AC corona charger of FIG. 11 and by setting the controller 14 so that $\Delta I<0$, the photosensitive medium 1 was charged in an atmosphere of temperature 25° C. and relative humidity 60%, to provide a surface potential −500 V. Thereafter, the atmosphere was changed to temperature 37° C. and relative humidity 93%, with a result that the surface potential of the photosensitive medium 1 remained at −500 V by being subjected to the AC corona charge. Thus, the change in the atmospheric conditions did not affect the surface potential of the photosensitive medium 3.

In contrast, in an experiment carried out by using the conventional charger, the surface potential of the photosensitive medium after being subjected to the corona charge changed from −500 V to −100 V for the same change in the atmospheric conditions.

Figure 12:
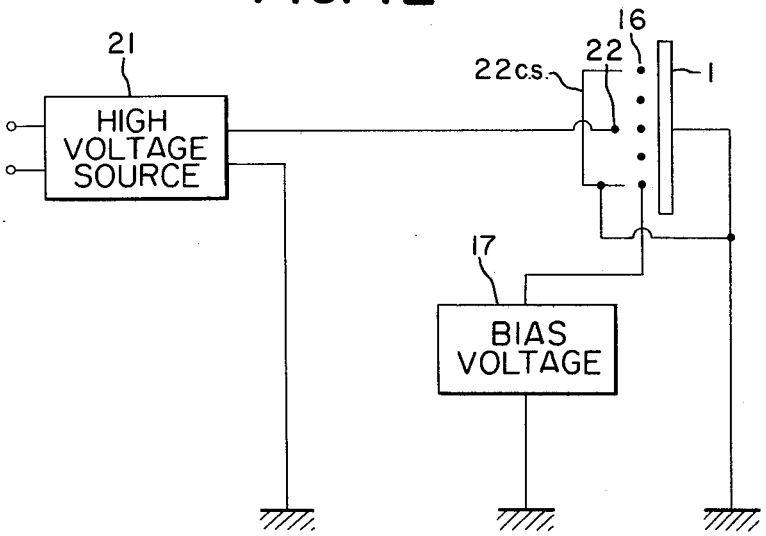
FIG. 12 shows a grid bias charger according to the prior art.

The charging method using the constant current difference and a grid will now be described. In FIG. 12 which shows an example of the conventional method, reference character 21 designates a high voltage source, 22 a corona discharge wire, 16 a grid, 17 a bias voltage source for supplying the necessary voltage to the grid, 22 c.s. a conductive shield and 1 a photosensitive medium.

In the case of AC charging, what determines the corona charging inclination is, as already noted, the current difference $\Delta I=I_{\oplus}-I_{\ominus}$ which is the difference between the plus component $I_{\oplus}$ and the minus component $I_{\ominus}$ of the corona discharge current (hereinafter referred to as the discharge current difference $\Delta I$).

The quantity of charge is determined by the discharge current difference $\Delta I$ of corona discharge and more strictly, in case of AC charging, part of the discharge current difference $\Delta I$ of the corona discharge from the corona discharge wire 22 flows outwardly through the conductive shield 22 c.s. of the charger and through the grid 16. That is, of the corona discharge current difference $\Delta I$, the polarity of the current difference $\Delta I_S$ of the corona discharge which flows outwardly through the conductive shield 22 c.s. (hereinafter referred to as the shield current difference $\Delta I_S$) and the polarity of the current difference $\Delta IC=\Delta I-\Delta IS-\Delta IG$ which flows outwardly through the grid 16 (hereinafter referred to as the effective current difference $\Delta IC$) determine the charging inclination and the magnitudes thereof directly determine the quantity of charge, namely, the value of the surface potential.

However, the charging method carried out with the bias voltage source 4 connected to the grid 16 was unsatisfactory in the following points.

Figure 14:
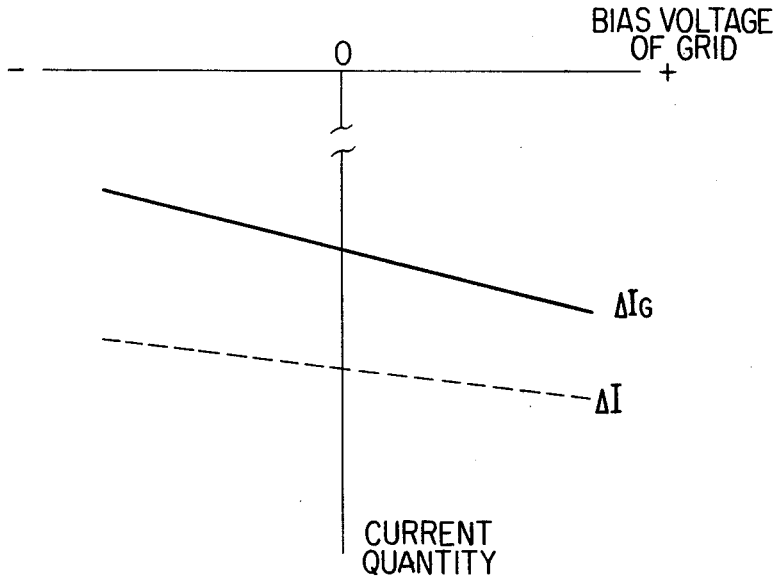
FIGS. 14 and 15 are graphs illustrating the characteristics of the corona current.
Figure 15:
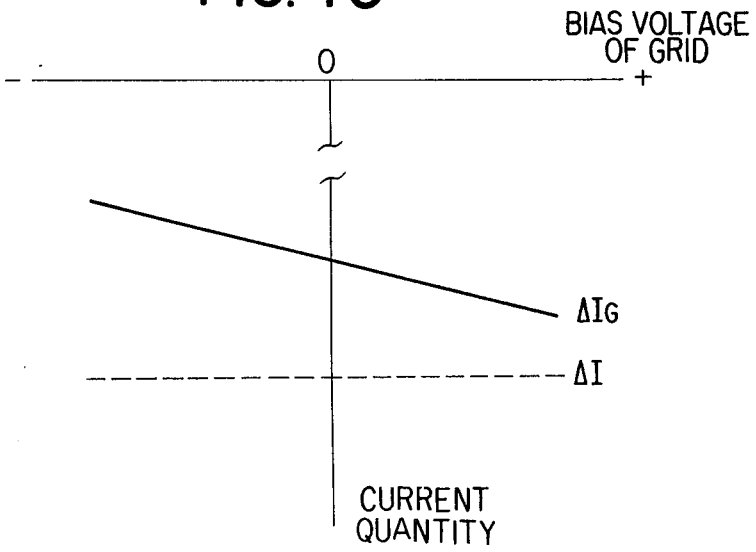

AC charge having the negative charging inclination will first be described as an illustrative example. The relation between the bias voltage of the grid 16 and the grid current difference $\Delta IG$ and the current difference $\Delta I$ of the high voltage output is such as shown in FIG. 14. More specifically, if a plus bias voltage is applied from the bias voltage source 17 to the grid 16 in order to control the surface potential of the photosensitive medium toward the positive direction (for example, if the surface potential is negative, to a small value of the positive sign), the absolute value of the grid current difference $|\Delta IG|$ is increased as indicated by the solid line in FIG. 14, whereby the absolute value of the effective current difference $|\Delta IC|$ is decreased to change the surface potential toward the positive direction. At the same time, the absolute value of the current difference of the high voltage output, $|\Delta I|$, is also increased as indicated by the broken line in FIG. 14. This suppresses the effect of the surface potential control toward the positive direction carried out by applying the bias voltage to the grid 16.

Conversely, if a minus bias voltage is applied from the bias voltage source 17 to the grid 16 in order to control the surface potential of the photosensitive medium 1 toward the negative direction, the absolute value of the grid current $|\Delta IG|$ is decreased as indicated by the solid line in FIG. 14, whereby the absolute value of the effective current difference is increased to change the surface potential toward the negative direction. At the same time, however, the absolute value of the current difference of the high voltage output, $|\Delta I|$, is decreased as indicated by the broken line in FIG. 14. That is, irrespective of the polarity of the bias voltage applied to the grid 16, there is an problem in that the discharge current of the high voltage output is changed so as to suppress the effect of the surface potential control toward the intended direction. Such a phenomenon is to be found in the AC charging having the positive charging inclination, as well as in the DC charging.

The conventional charging method using a grid has also caused a problem in that where the bias voltage supplied from the bias voltage source 17 to the grid 16 is fixed, the change in surface potential is not sufficiently compensated for even by the use of the high voltage source 21 of constant current, with respect to the change in corona discharge resistance resulting from the change in the distance between the discharge wire 22 and the photosensitive medium 1 and the change in the atmospheric conditions such as temperature and humidity. To compensate for this, there is a charging method in which the bias voltage supplied from the bias voltage source 17 is controlled in accordance with the surface potential of the photosensitive medium 1, but this method suffers from the disadvantage that the device for carrying it out becomes complex.

The conventional charging method using the grid 16 raises a further problem in that a considerable part of the output current from the high voltage source 21 has to be wastefully flowed outwardly through the shield 22 c.s. because this shield is conductive and the shield current IS or the shield current difference $\Delta IS$ cannot be nulled.

In contrast with the conventional charging method using a grid, the present invention can null the shield current difference $\Delta IS$ of the AC corona discharge current difference, thereby enabling the current difference $\Delta I$ to be utilized efficiently.

Thus, the present invention embodies a further advantage in that the current difference between the plus and the minus component of AC corona discharge current is maintained constant and the surface potential is provided stably by a grid disposed adjacent to the surface of the chargeable member.

This enables a corona charging in which the range of the surface potential controlled by adjustment of the grid potential is wide and stable and moreover, the use of corona discharge enables the charging to be effected without reducing the discharge voltage for low current discharge and without keeping the discharge wire at a distance from the photosensitive medium.

Figure 13:
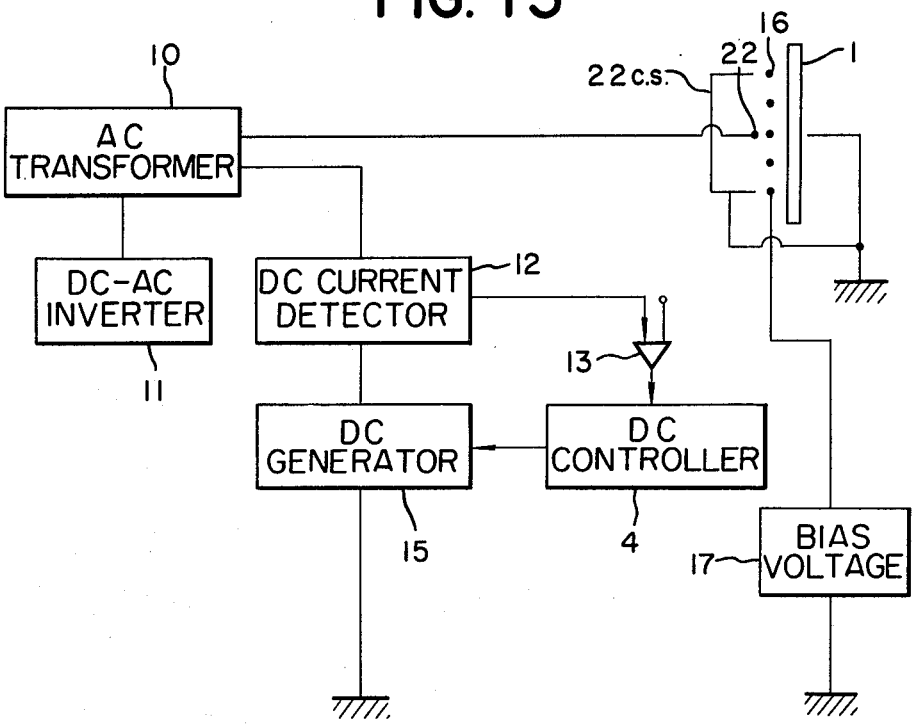
FIG. 13 shows another embodiment of the charging method and device according to the present invention.

FIG. 13 diagrammatically shows an embodiment of the present invention. The power source circuit is similar in construction to that of FIG. 11 and can provide an AC output having the current difference ΔI maintained constant in the manner already described. By supplying this controlled Ac output to the corona discharge wire 22, the current difference ΔI of corona discharge can be maintained constant independently of the polarity and magnitude of the bias voltage supplied from the bias voltage source 4 to the grid 16. Thus, the bias effect of the grid 16 can be enhanced as compared with the conventional AC charging, and the surface potential obtained is stable against the change in atmospheric conditions and the range of the surface potential controlled can be widened.

Figure 16:
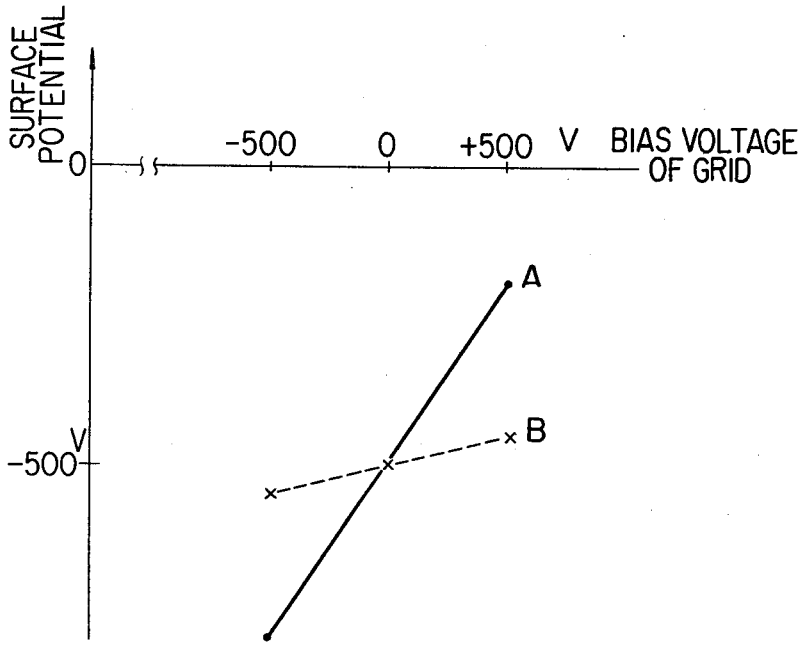
FIG. 16 graphically illustrates the characteristic of the surface potential with respect to grid bias.

FIG. 16 shows an example of the comparison between the change A in surface potential for the bias voltage of the grid 16 obtained by the charging method of FIG. 13 and the change B in surface potential for the bias voltage of the grid 16 obtained by the conventional AC charging method. This example refers to the use of AC corona charging having the negative charging inclination, wherein the dots "." indicate the change A in surface potential provided by the charging method of FIG. 13 and the marks "X" indicate the change B in surface potential provided by the conventional AC charging method.

In the case of such AC corona charging having the negative charging inclination, a bias voltage of the plus polarity may be applied from the bias voltage source 17 to the grid 16, in contrast with the case of a grounded grid 16, if the surface potential of the photosensitive medium 1 is to be controlled toward the positive direction. But according to the conventional AC charging method, the absolute value of the discharge current difference, $|\Delta I|$, shown in FIG. 14, is increased and the absolute value of the grid current difference $|\Delta IG|$ is increased while the absolute value of the effective current difference $|\Delta IC|$ is decreased. Let $|\Delta I|g$, $|\Delta IS|g$, $|\Delta IG|g$ and $|\Delta IC|g$ be the absolute values of the discharge current difference, the grid current difference and the effective current difference, respectively, when the grid 16 is grounded, and let $|\Delta I|\oplus$, $|\Delta IS|\oplus$, $|\Delta IG|\oplus$ and $|\Delta IC|\oplus$ be the absolute values of the discharge current difference, the shield current difference, the grid current difference and the effective current difference, respectively, when a bias voltage of the plus polarity is applied to the grid 16. Then, there is the following relation:

$$|\Delta I|g-|\Delta IS|g-|\Delta IG|g>|\Delta I|\oplus-|\Delta IS|\oplus-|\Delta IG|\oplus$$

That is, $$|\Delta IC|g>|\Delta IC|\oplus$$

Thus, the surface potential of the photosensitive medium 1 is changed toward the positive direction. At the same time, however, $$|\Delta I|g<|\Delta I|\oplus,$$

and therefore, the effect of the surface potential control carried out by applying the bias voltage to the grid 16 is suppressed, so that the surface potential of the photosensitive medium assumes the change B as indicated by "X".

Figure 20:
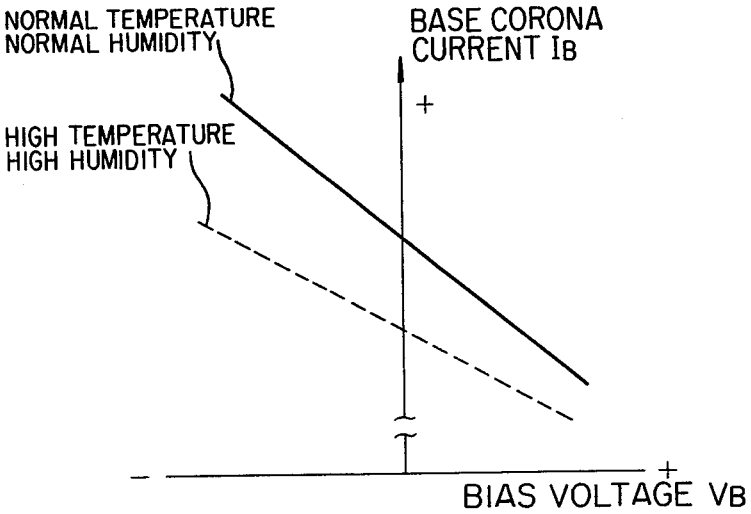
FIG. 20 is a graph illustrating the corona discharging performance of the corona discharger according to the prior art.

In contrast, the AC charging method of FIG. 13 according to the present invention can bring about a relation that $|\Delta I|g=|\Delta I|\oplus$ so that the relations between the bias voltage of the grid 16 and the grid current difference ΔIG and the current different ΔI of the high voltage output become such as shown in FIG. 20. Thus, the current difference ΔI of the high voltage output can be maintained constant independently of the bias voltage applied to the grid 16, whereby the change in the effective corona current difference ΔIC resulting from the change in the grid current difference ΔIG becomes much greater than in the case of the conventional AC charging. In this manner, as shown in FIG. 16, the effect of the surface potential control carried out by applying a bias voltage to the grid becomes more remarkable than in the case of the conventional AC charging and brings about the surface potential change A of the photosensitive medium 1 as indicated by ".". The control of the surface potential of the photosensitive medium 1 toward the positive direction has been described above, but a similar result may also be obtained in the control toward the negative direction.

In FIG. 13, the conductive shield 22 c.s. is shown, whereas in the AC charging method of the present invention, this shield may be replaced by an insulative shield and as already described in connection with FIG. 4, the three sides of the corona discharge wire 22 other than the opening portion thereof may be formed of an insulative shield so that the quantity of current flowing outwardly through the shield can be substantially null. Further, in such case, the shield current difference ΔIS is zero so that the intended effective current difference ΔIC can be obtained for a smaller current difference ΔI, namely, a smaller corona discharge current I, than in the conventional AC corona charging.

As a further embodiment, there is a method which uses the afore-mentioned insulative shield and grid with the charger of FIG. 8.

By applying the so controlled AC output to the corona discharge wire 22, it is possible to maintain the corona discharge current difference ΔI constant and also maintain the voltage applied to the corona discharge wire constant, and this in turn leads not only to the increased effect of the surface potential control by the bias voltage applied to the grid, but also to the production of a surface potential which is much more stable against the change in corona discharge resistance resulting from the change in the distance between the corona discharge wire 2 and the photosensitive medium 1 and the change in atmospheric conditions such as temperature and humidity.

Figure 17:
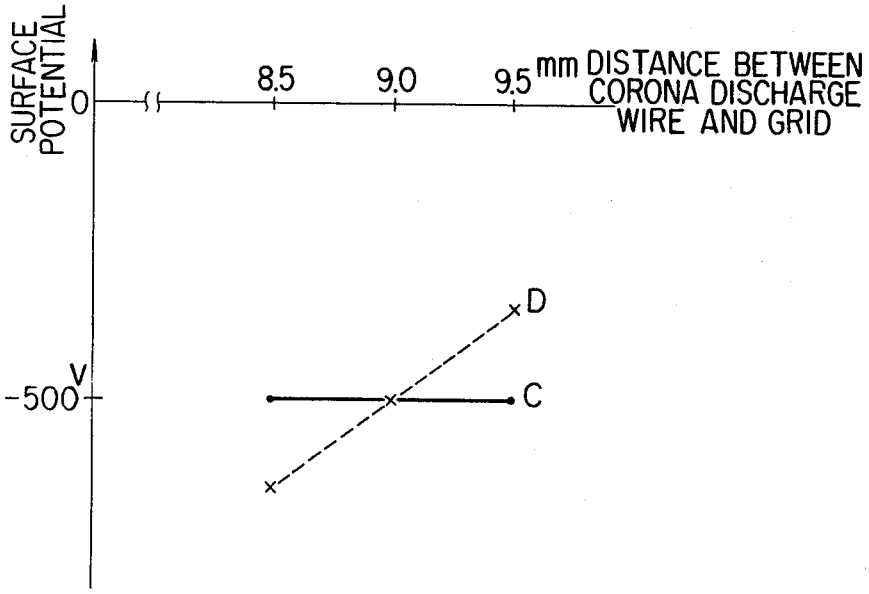
FIG. 17 is a graph illustrating the characteristics of the surface potential with respect to the distance between the corona discharge wire and the grid in the prior at and in the present invention, respectively.

FIG. 17 shows an example of the comparison between the surface potential change C of the photosensitive medium 1 when the distance between the photosensitive medium and the grid 16 is maintained constant but the distance between the corona discharge wire 22 and the photosensitive medium 6 is changed, namely, the distance between the corona discharge wire 22 and the surface of the grid 16 is changed, and the surface potential change D of the photosensitive medium 1 when the same operation is effected according to the conventional AC charging method. This refers to the case of the AC corona charging having the negative charging inclination. The dots "." indicate the surface potential change C according to the present invention and the marks "X" indicate the surface potential change D according to the prior art.

According to the conventional AC charging method, and in the case of the negative charging inclination as shown in FIG. 17, if the corona discharge wire 22 is kept away from the surface of the grid 16, the corona discharge resistance is increased while the absolute value $|\Delta I|$ of the current difference of corona discharge is decreased and the absolute value $|\Delta IC|$ of the effective current difference is also decreased to decrease the quantity of charge, with a result that the surface potential of the photosensitive medium 1 is changed toward the positive direction. Such a phenomenon is unavoidable even in DC charging, if the bias voltage applied from the bias voltage source 17 to the grid 16 is fixed, and where a high voltage source 1 of constant voltage is used, the corona discharge current I is changed by the change in corona discharge resistance resulting from the change in the distance between the corona discharge wire 22 and the surface of the grid 16, and the effective corona current IC is also changed to change the surface potential of the photosensitive medium 1. Also, where a high voltage source 21 of constant total AC is used, the corona discharge current I can be maintained constant but the voltage V applied to the corona discharge wire 22 is changed by the change in corona discharge resistance resulting from the change in the distance between the corona discharge wire 22 and the surface of the grid 16, so that the effective corona current IC is changed to change the surface potential of the photosensitive medium 1.

Unlike these conventional charging methods, according to the charging method using the circuit arrangement of FIG. 8 and a grid, the current difference $\Delta I$ of corona discharge and the voltage V applied to the corona discharge wire 22 are maintained substantially constant even with a change in corona discharge resistance resulting from the change in the distance between the corona discharge wire 22 and the photosensitive medium 1 and the change in atmospheric conditions such as temperature and humidity. Thus, according to the AC corona charging method of the present invention, there is provided a surface potential which is substantially unaffected by the change in corona discharge resistance resulting from the change in the distance between the corona discharge wire 2 and the photosensitive medium 1 and the change in atmospheric conditions such as temperature and humidity. That is, an effect of substantial coexistence of constant voltage and constant current is obtained by effecting the control of constant voltage and constant current difference by the use of AC corona charging, instead of effecting the control of constant voltage and constant current which could not theoretically be realized by DC corona charging, and there is obtained a surface potential which is stable against the change in corona discharge resistance resulting from the change in the distance between the corona discharge wire 22 and the photosensitive medium 1 and the change in atmospheric conditions such as temperature and humidity, namely, an electrostatic latent image which is extremely high in reliability.

To obtain further stability of the above-described surface potential, a conductive shield 22 c.s. may be used instead of the insulative shield 5-2.

Also, the grid bias may be changed by a self-bias which comprises a grid grounded through a resistor or by changing the location of the grid.

As described hereinabove, the present invention effects the charging by the AC corona discharging having a constant current difference and the bias by the grid and this leads to ease of control of the surface potential and the possibility of producing a surface potential which is highly stable against the change in corona discharge resistance or the like.

The present invention further provides an electrophotographic method for carrying out the corona charging which is substantially unaffected by the change in corona discharge resistance resulting from the change in atmospheric conditions such as temperature and humidity and the change in the distance between the corona discharge wire 22 and the photosensitive medium 1, thereby enabling a visible image to be obtained stably.

Figure 18:
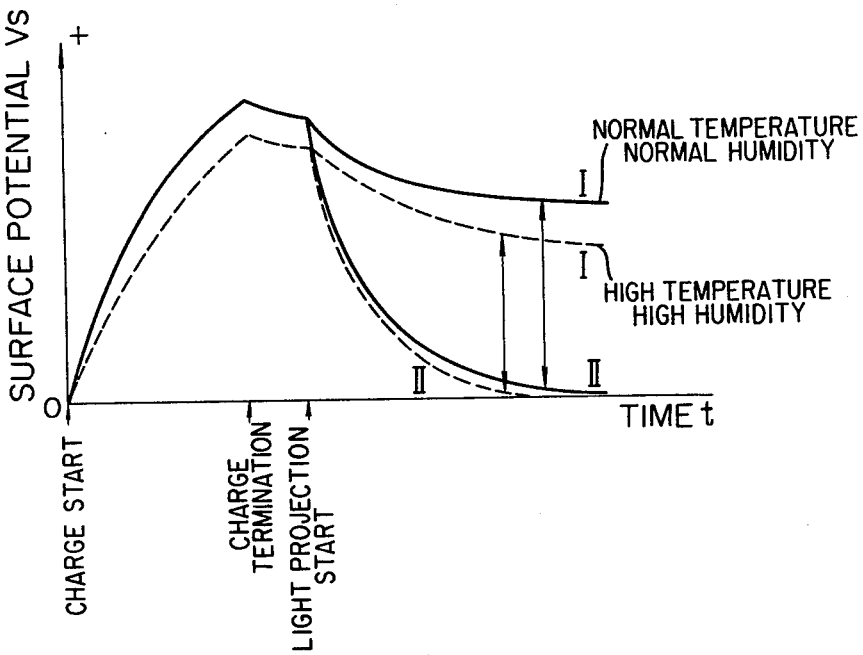
FIG. 18 is a graph illustrating the variation with time in the surface potential of the photosensitive medium.

FIG. 18 illustrates the change in surface potential of the photosensitive medium 1 resulting from conventional corona change. The solid line indicates the surface potential change for a atmosphere of normal temperature and normal humidity, and the broken line indicates the surface potential change for high temperature and high humidity. Curve I represents the surface potential change for the dark region of the image and curve II represents the surface potential change for the light region of the image. As will be seen, the values of the surface potentials for the dark and light regions of the image are changed by the atmospheric conditions and the difference between those values is also changed.

Figure 19:
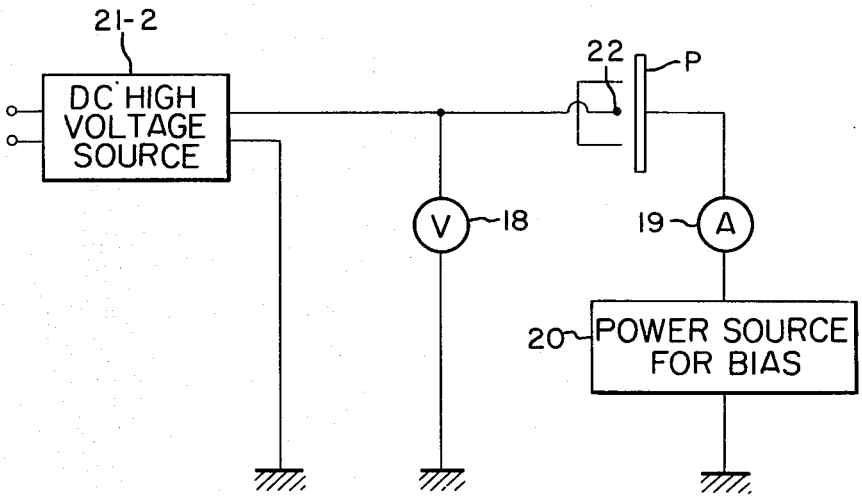
FIG. 19 schematically illustrates the method of measuring the corona discharging performance.

FIG. 19 shows the method of measuring the corona charging performance of each individual corona charger. A corona current measuring probe is shown comprising a conductive flat electrode P, 18 a voltmeter, 19 an ammeter, and 20 a bias voltage source for imparting a bias voltage to the electrode P. Measurement may be done by reading the current flowing to the base through the electrode (hereinafter referred to as the base corona current $I_B$) when the voltage of the bias voltage source 20 is varied with the applied voltage V to the corona discharge wire 22 being fixed.

FIG. 20 illustrates the relation between the bias voltage $V_B$ and the base corona current $I_B$ when a plus voltage V is applied to the corona discharge wire 22. With a predetermined range, a linear relation is established between the bias voltage $V_B$ and the base corona current $I_B$. The solid line indicates the charging performance for normal temperature and normal humidity, and the broken line indicates the charging performance for high temperature and high humidity. Thus, $$I_B = G \cdot V_B + I_O \quad (1),$$

where G represents the gradient of the straight line in the graph of FIG. 20 and $I_O$ represents a slice of the straight line on the $I_B$ axis. Both G and $I_O$ have values determined by the construction of the corona charger, the applied voltage to the corona discharge wire, and the atmospheric conditions, etc. When the photosensitive medium 1 is charged by a corona charger having such a charging performance, the surface potential $V_S$ of the photosensitive medium 1 satisfies the following differential equation with C as the electrostatic capacity thereof. However, it is to be noted that there is no leak from the surface of the photosensitive medium through the photoconductive layer thereof.

$$C \cdot \frac{dV_S}{dt} = I_S, \quad (2)$$

where $I_S$ represents the corona current flowing into the surface of the photosensitive medium and equals equation (1) if the surface potential $V_S$ is substituted for the bias voltage $V_B$ in that equation. Thus, equation (2) may be rewritten:

$$C \cdot \frac{dV_S}{dt} = G \cdot V_S + I_O \quad (3)$$

By solving this, there may be obtained the following:

$$V_S = \frac{I_O}{G} + \left(\frac{I_O}{G} + V_O\right) \exp\left(\frac{Gt}{C}\right), \quad (4)$$

where t is the time measured with the corona charge start time as the origin and $V_O$ is the surface potential of the photosensitive medium 1 when t=0. Once the gradient G of the straight line and the slice $I_O$ of the straight line on the $I_B$ axis are known from the measurement of the corona charging performance in FIG. 19, the surface potential of the photosensitive medium 1 may be estimated from equation (4) if the charging time is given.

As shown in FIG. 20, the gradient G of the straight line and the slice $I_O$ of the straight line on the $I_B$ axis have variable values with the change in corona discharge resistance resulting from the change in atmospheric conditions such as temperature and humidity, etc. As the result, it was unavoidable for the surface potential $V_S$ to be also changed by the change of the atmospheric conditions from normal temperature and normal humidity to high temperature and high humidity. This can be inferred from equation (4), as well.

The present invention overcomes such inconvenience by utilizing the AC corona discharge having a constant current difference, instead of the DC corona discharge.

In the conventional AC charging, when the charging performance of FIG. 19 is measured, the corona current difference $\Delta I_B$ flowing to the base through the electrode P (hereinafter referred to as the base corona current difference $\Delta I_B$) establishes a linear relationship with the bias voltage $V_B$, within a predetermined range, and becomes a straight line having the gradient G as in the case of FIG. 20 for the DC charging. That is, the gradient G of the straight line and the slice $\Delta I_O$ of the straight line on the $\Delta I_B$ axis are changed by the change in atmospheric conditions as in the DC charging and thus, the surface potential produced by the conventional AC charging was also changed.

Figure 21:
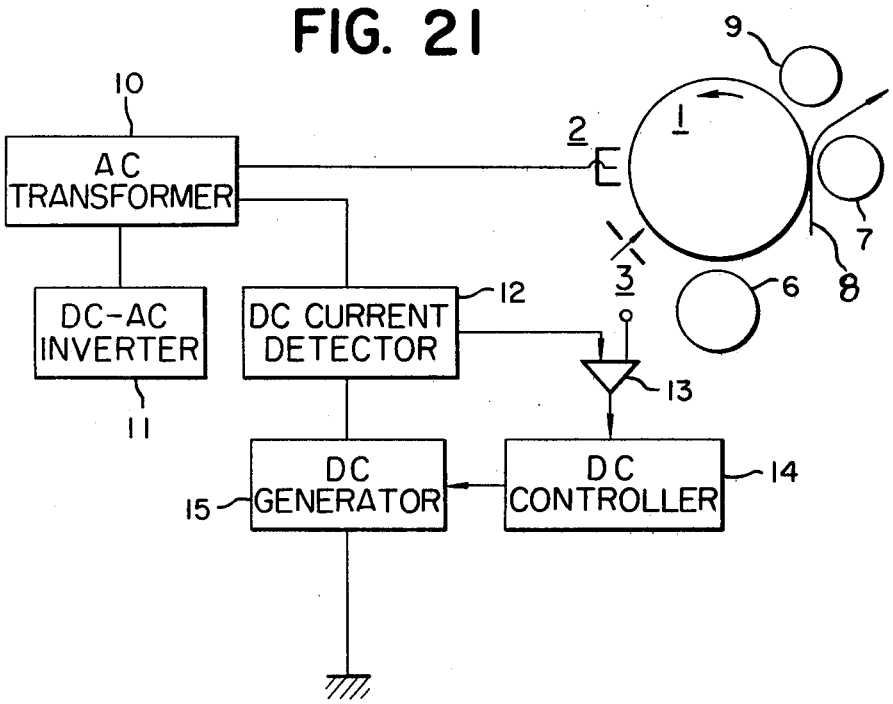
FIG. 21 shows an embodiment of the electrophotograph method provided with the AC corona charger according to the present invention.

FIG. 21 diagrammatically shows an electrophotographic method using an AC high voltage output which, unlike the conventional AC high voltage output, can take out a constant output current difference even if there is a change in load. The power source for the charger is identical with that of FIG. 11.

Figure 22:
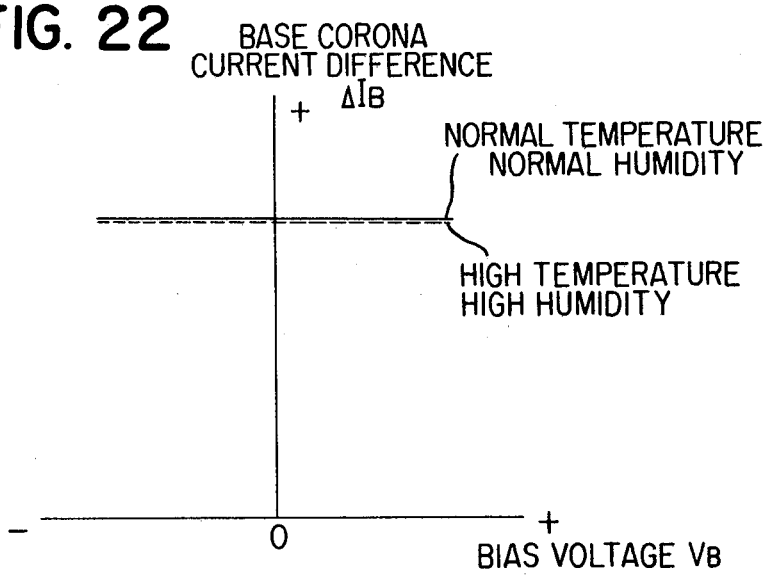
FIG. 22 is a graph illustrating the charging performance of the AC corona discharger according to the present invention.

The charging performance in this example as measured by the method of FIG. 19 is such as shown in FIG. 22. This refers to the case of the AC charging having the positive charging inclination. The solid line indicates the charging performance for normal temperature and normal humidity, and the broken line indicates the charging performance for high temperature and high humidity. This may be formulated as follows:

$$\Delta I_B = \Delta I_O \quad (1)',$$

where $\Delta I_O$ represents the base corona current difference maintained constant by the method of FIG. 21. By the same procedure as that described above, the surface potential $V_S$ is given as follows:

$$V_S = V_O + \frac{\Delta I_O}{C} \cdot t \quad 4)'$$

This equation (4)' does not include any factor which is variable by the change in corona discharge resistance attributable to the change in atmospheric conditions, etc., and accordingly, there is provided a stable electrophotographic apparatus.

Description will now be made of an electrophotographic method which is effective for use with a three-layer photosensitive medium.

The station for simultaneous AC charging and exposure has heretofore been comprised of a charger connected to an AC high voltage source of constant voltage. Therefore, when the corona discharge resistance was changed by the change in atmospheric conditions such as temperature and humidity or the change in the distance between the corona discharge wire and the surface of the photosensitive medium, the corona discharge current I was changed to thereby change the values of the surface potentials corresponding to the light and dark regions of the image formed on the photosensitive medium and the difference between the two values. Such a phenomenon could not sufficiently be compensated for because, even the corona discharge was effected by an AC high voltage source of constant current, and the applied voltage to the corona discharge wire was changed by the change in corona discharge resistance resulting from the change in atmospheric conditions such as temperature and humidity or the change in the distance between the corona discharge wire and the surface of the photosensitive medium. A method for detecting the surface potential of the photosensitive medium and controlling the applied voltage to the corona discharge wire has also been attempted, but this complicates the device.

Further, where it is desired to provide as great a difference as possible between the surface potentials of the photosensitive medium corresponding to the light and dark regions of the image thereon, the method of latent image formation using the conventional AC corona discharge at the station for simultaneous AC charging and exposure has not been free from the following problem.

FIG. 24 illustrates the manner in which electrostatic latent image formation is effective in the conventional station for simultaneous secondary charging and exposure. Designated by (A) is a transparent insulating layer, (B) a photoconductive layer (herein shown as having the property of N type semiconductor), and (C) a conductive base. Indicated by $l_1$ and $l_2$ are the thicknesses of the photoconductive layer (B) and the transparent insulating layer (A), $\epsilon_1$ and $\epsilon_2$ the dielectric constants of the layers (B) and (A), and $q_2$, $q_0$ and $q_1$ the absolute values of the quantity of charge on the transparent insulating layer (A) at the end of the step of simultaneous AC charging and exposure, the quantity of charge in the boundary between the layers (A) and (B), and the quantity of charge in the boundary between the photoconductive layer (B) and the conductive base (C). FIG. 24(*a*) shows the locations of charges at the end of the primary charging, FIG. 24(*b*) shows the locations of charges during the step of simultaneous AC charging and exposure, and FIG. 24(*c*) shows the locations of charges at the end of the simultaneous AC charging and exposure, namely, the state in which the surface has been discharged. The right-hand half of each of FIGS. 24(*a*) and (*c*) corresponds to the light region of the image, and the left-hand half corresponds to the dark region of the image. FIG. 24(*d*) shows the potential within the photosensitive medium at the end of the simultaneous AC charging and exposure. In FIG. 24(*d*), solid line L is the potential curve corresponding to the light region of the image, and broken line D is the potential curve corresponding to the dark region of the image. FIG. 24 is an ideal case where no charge is trapped in the photoconductive layer (B), and this will generally explain the actual tendency.

Now, the surface potential $V_L$ of the electrostatic latent image finally obtained in FIG. 24(*d*) which corresponds to the light region of the image and the surface potential $V_D$ which corresponds to the dark region of the image may be expressed by the use of the symbols appearing in FIG. 24.

$$V_L = \frac{q_2^L}{\epsilon_2} \cdot l_2 \quad (1)$$

$$V_D = \frac{q_2^D}{\epsilon_2} l_2 - \frac{q_1^D}{\epsilon_1} \cdot l_1 \quad (2)$$

From this, the difference $V_C$ between $V_L$ and $V_D$ (hereinafter referred to as the contrast potential $V_C$) is given as:

$$V_C = \frac{q_1^D}{\epsilon_2} l_1 - \frac{(q_2^D - q_2^L)}{\epsilon_2} \cdot l_2, \quad (3)$$

where $q_1^L$ and $q_2^L$ means the $q_1$ and $q_2$ corresponding to the light region of the image, and $q_1^D$ and $q_2^D$ means the $q_1$ and $q_2$ corresponding to the dark region of the image. If the simultaneous AC charging and exposure was executed by a charger using the conventional AC high voltage source 8, the corona discharge resistance corresponding to the dark region of the image would be greater than the corona discharge resistance corresponding to the light region of the image, as shown in FIG. 24(*b*), so that the quantity of AC charge was unavoidably less in the portion corresponding to the dark region of the image than in the portion corresponding to the light region of the image. This led to the result that in equation (3), the first term was decreased and the second term was increased ($q_2^D > q_2^L$), and accordingly caused the contrast potential $V_C$ to be reduced.

An electrophotographic method will now be illustrated in which charging and exposure are effected simultaneously or successively by the AC corona discharge having a constant current difference ΔI, thereby forming an electrostatic latent image.

Figure 1:
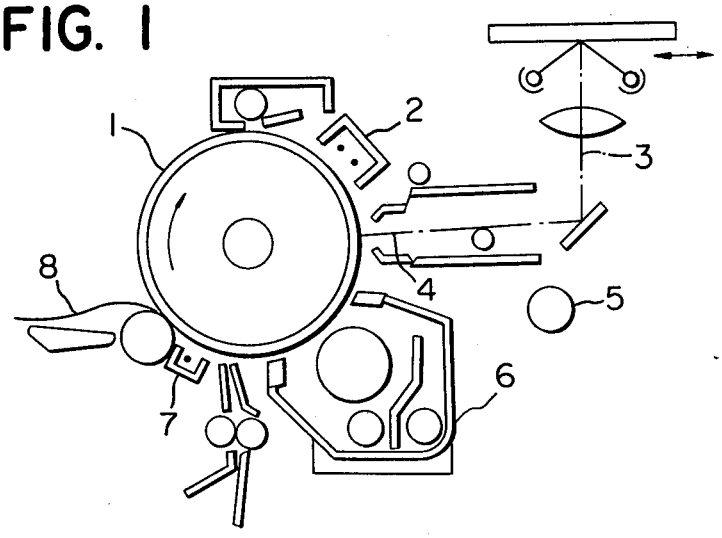
FIG. 1 schematically shows an example of the electrophotographic process to which the present invention is applicable.
Figure 23:
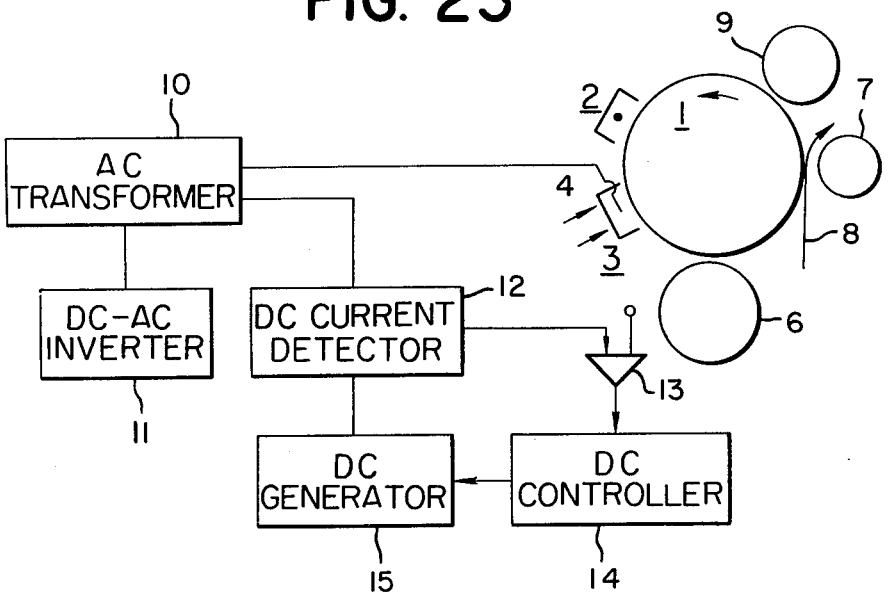
FIG. 23 diagrammatically shows an example of the electrophotographic method using the constant current difference of the present invention.

FIG. 23 schematically shows the electrophotographic process using the AC charging process according to the present invention. It will be appreciated from the pictorial presentation of FIG. 23 and from the foregoing description of the invention, that FIG. 23 depicts an electrophotographic apparatus having a photosensitive drum upon which a latent image may be formed by use of a DC primary, corona charger 2, as in FIG. 1; an AC corona charger 4 for applying a secondary charge to the drum simultaneously with the exposure thereof to image light as indicated by the arrows 3 adjacent to the secondary charger 4; a developer device for developing a latent image applied to the drum 1 by the image light and the corona devices 2 and 4; a transfer device 7 for transferring the developed latent image from the drum 1 onto a sheet of copy paper 8; and a cleaning device 9 for preparing the surface of the drum for receiving a subsequent latent image. Designated by 10 is an AC transformer, 11 an inverter, 12 a DC current detector, 13 an amplifier, 14 a DC controller and 15 a DC generator. The current difference ΔI of the high voltage output is detected by the DC current detector 12 and passed through the amplifier 13 into the DC controller 14. In the DC controller 14, feedback to the DC generator 15 is effected so as to maintain the current difference at a predetermined value.

The shield of the charger forming the station for simultaneous AC charging and exposure is formed by a transparent insulative shield at least in the portion thereof which lies in the optical path. That is, where the three sides other than the opening portion of the charger is formed by an insulative shield, corona discharge in the DC charging is only insufficiently accomplished and is not practical, whereas corona discharge in the AC charging can be accomplished sufficiently. Moreover, the quantity of current flowing outwardly through the shield can be substantially nulled so that the output current difference intactly provides the current difference ΔI of corona discharge. Thus, if the DC controller 14 is set so that the current difference is zero, there will be provided the AC charging having the zero charging inclination; if the DC controller 14 is set so that the current difference becomes positive, there will be provided the AC charging having the positive charging inclination; and if the DC controller 14 is set so that the current difference becomes negative, there will be provided the AC charging having the negative charging inclination. The high voltage output having any of these charging inclinations may also be supplied to the corona charger in the primary charging station to stabilize the primary charging.

FIG. 25 illustrates the locations of charges in the photosensitive medium 1 at the station for simultaneous AC charging and exposure when an electrostatic latent image is to be formed by the method of FIG. 23. The significances of the symbols in FIG. 25 are identical to those in FIG. 24. The difference of FIG. 25 from FIG. 24 is that during the step of simultaneous AC charging and exposure shown in (a), equal quantities of charge take place in the portion corresponding to the light region of the image and the portion corresponding to the dark region of the image. This is rendered possible only by the AC charging which can provide for a constant current difference ($\Delta I < 0$) irrespective of the magnitude of the load resistance. Noting the contrast potential $V_C$ at the end of the simultaneous secondary charging and exposure shown in (c), it is seen that in equation (3), the first term can be increased ($q_1^D$ greater) and the second term can be nulled ($q_2^D = q_2^L$), so that the contrast potential $V_C$ is increased. This is an improvement in sharpening the visible image.

Figure 26:
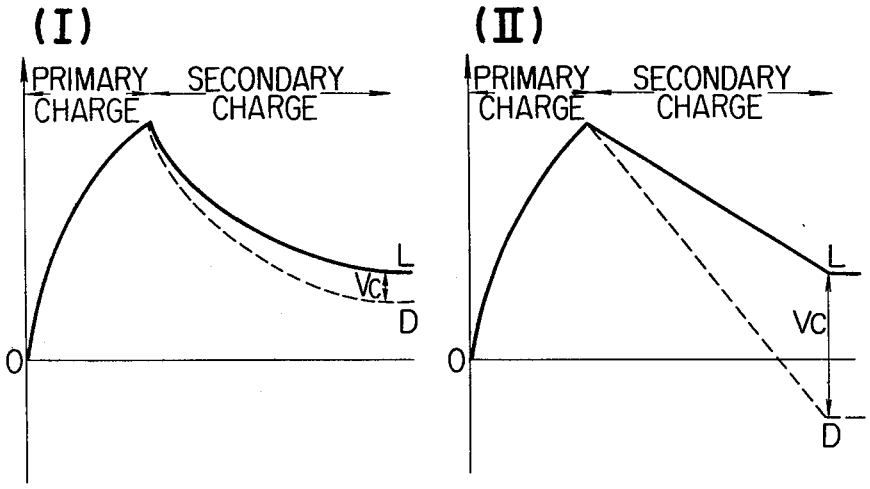
FIG. 26 graphically illustrates the change in surface potential of the photosensitive medium during the electrostatic latent image formation.
Figure 24A:
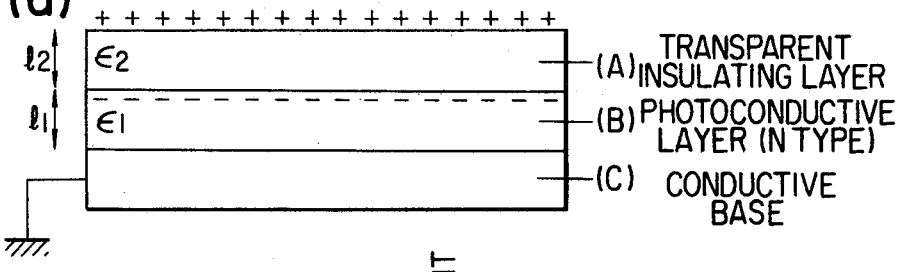
FIG. 24 is a schematic representation for illustrating the locations of chargers in the photosensitive medium during the electrostatic latent image formation by the conventional electrophotographic method and the characteristic of the potential finally obtained.
Figure 24B:
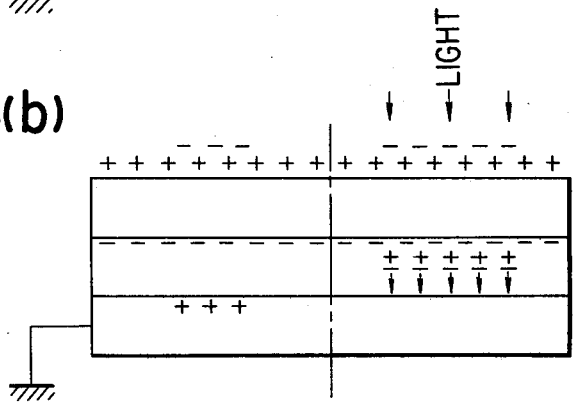
Figure 24C:
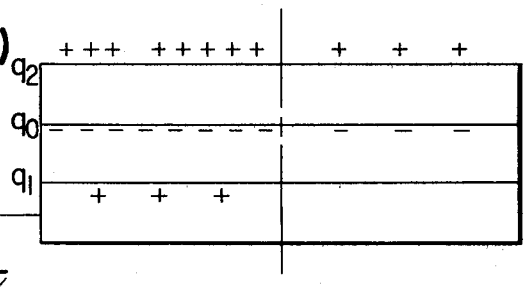
Figure 24D:
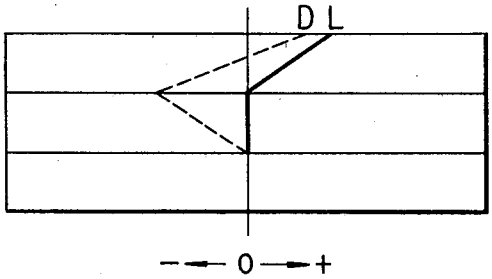
Figure 25A:
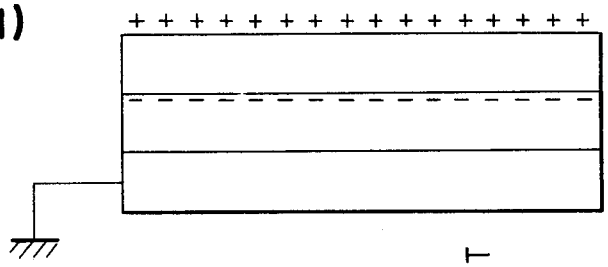
FIG. 25 is a schematic representation for illustrating the locations of charges in the photosensitive medium during the electrostatic latent image formation by the simultaneous AC charging and exposure in the present invention and the characteristic of the potential finally obtained.
Figure 25B:
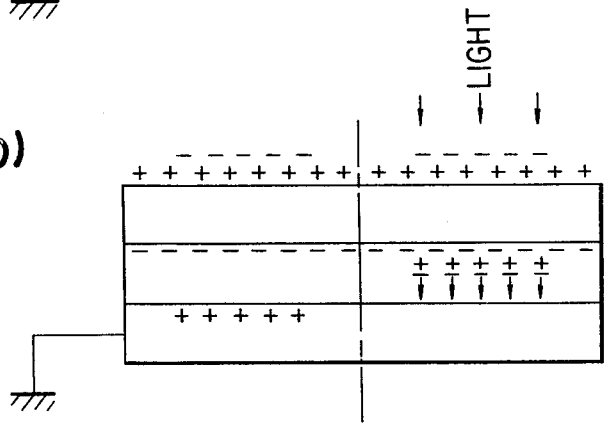
Figure 25C:
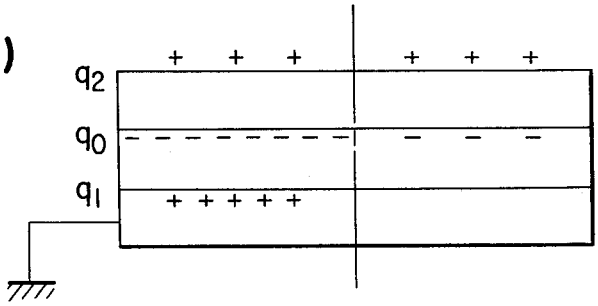
Figure 25D:
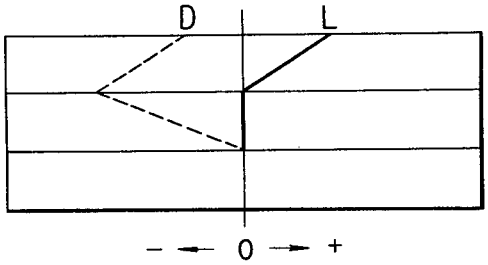

FIG. 26 illustrates the changes with time in surface potential of the photosensitive medium during the electrostatic latent image formation according to the conventional method and to the method of the present invention. FIG. 26(I) refers to the conventional method and FIG. 26(II) refers to the method of the present invention. It is seen that the surface potential D corresponding to the dark region of the image can be greatly displaced toward the negative direction, whereby the contrast potential $V_C$ is increased.

As a further embodiment, there is a method using the voltage source of FIG. 8. According to this method, the corona discharge current difference ΔI can be maintained constant and the applied voltage to the corona discharge wire can also be maintained constant, so that the surface potential of the photosensitive medium 1 is not substantially changed even if the corona discharge resistance is changed by the change in atmospheric conditions such as temperature and humidity and the change in the distance between the corona discharge wire and the photosensitive medium 1.

Thus, instead of the control of constant voltage and constant current which could not theoretically be realized by the conventional AC or DC corona charging, the control of constant voltage and constant current difference can be accomplished by the AC corona charging and the effect of substantial coexistence of constant voltage and constant current can be achieved, thereby providing a stable electrostatic latent image. A similar effect may be obtained by using a conductive shield instead of the insulative shield.

If the photosensitive medium is of a high memory capacity, the present invention permits the primary corona charging, the exposure and the secondary corona charging to take place in succession and this will particularly be effective where there is a residual influence of the corona discharge resistance resulting from the light and dark of the exposure. Alternatively, the primary charging, the secondary charging and the exposure may take place successively in the named order.

The next example is such that charging and exposure are effected simultaneously or successively by AC corona charging having a constant current difference ΔI and by a conductive charge application control member such as a grid or the like disposed adjacent to the surface of the photosensitive medium, thereby forming an electrostatic latent image.

Figure 27:
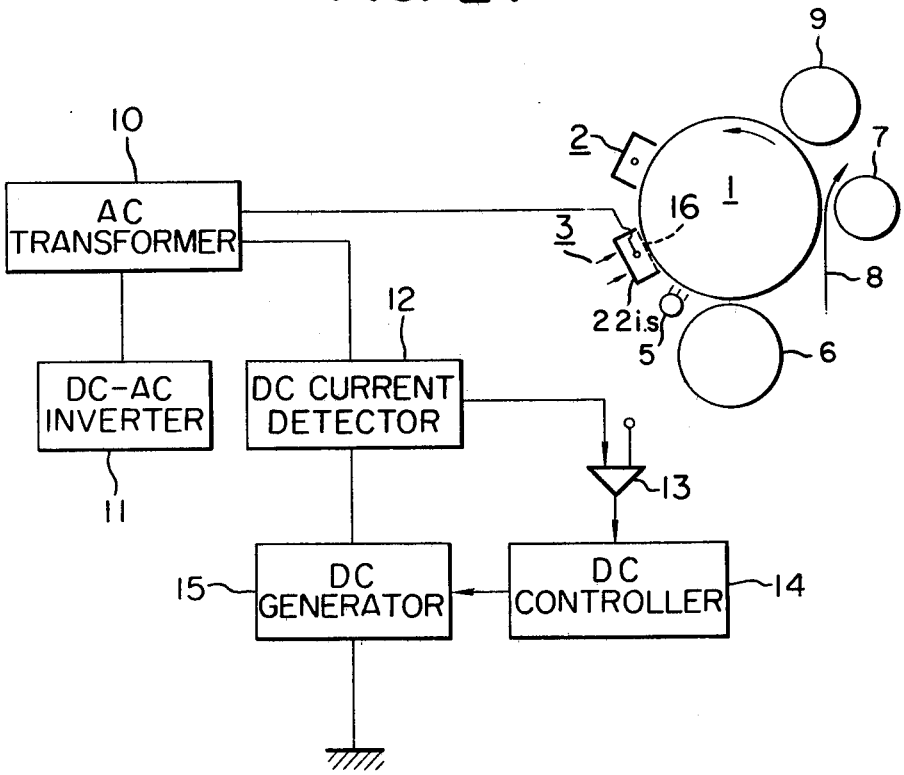
FIG. 27 diagrammatically shows an example of the electrophotographic method provided with the station for simultaneous AC charging and exposure.

FIG. 27 shows an example of the electrophotographic method using the AC high voltage output according to the present invention. Designated by 16 is a grid, and 22 i.s. an insulative shield. The other members are similar to those in FIG. 4. The current difference ΔI of the high voltage output is detected by the DC current detector 12 and passed through an amplifier 13-1 into the DC controller 14. In the DC controller 14, feedback to the DC generator 15 is effected so as to maintain the current difference at a predetermined value. The insulative shield 22 i.s. is formed of a transparent material at least in the portion thereof which lies in the optical path. In the case of DC charging, if the three sides of the charger other than the opening portion are formed by an insulative shield, corona discharge can only insufficiently be accomplished and is not practical, whereas in the case of AC charging, corona discharge can be effected sufficiently. Moreover, by the shield being made insulative, the quantity of current flowing outwardly through the shield can be substantially nulled, so that the AC output current difference ΔI can be intactly flowed toward the photosensitive medium. Thus, the AC output current difference ΔI set by the DC controller 14 can be maintained constant, irrespective of the presence of a change in corona discharge resistance resulting from a change in atmospheric conditions such as temperature and humidity and a change in the distance between the corona discharge wire and the photosensitive medium, whereby the AC output current difference can be utilized as a stable corona discharge current difference ΔI.

The grid 16 is the means for forming charge patterns corresponding to the light and dark regions of the image, and a suitable bias voltage including OV is applied thereto. FIG. 28 shows the locations of charges in the photosensitive medium during the electrostatic latent image formation process in the above-described electrophotographic method. Designated by (A) is a transparent insulating layer, (B) an N type photoconductive layer, and (C) a conductive base. FIG. 28(*a*) shows the locations of charges at the end of the primary charging, FIG. 28(*b*) shows the locations of charges during the simultaneous AC charging and exposure, FIG. 28(*c*) shows the locations of charges at the end of the simultaneous AC charging and exposure, FIG. 28(*d*) shows the locations of charges during the whole surface exposure, effected by the overall exposure lamp 5 illustrated in FIG. 27, and FIG. 28(*e*) shows the locations of charges at the end of the whole surface exposure.

The right-hand half of each of FIGS. 28(*a*) to (*e*) corresponds to the light region of the image, and the left-hand half corresponds to the dark region of the image. FIG. 28 refers to an ideal case where there is no charge trapped in the photoconductive layer (B), and this will generally explain the actual tendency.

During the simultaneous AC charging and exposure shown in FIG. 28(*a*), the quantity of surface charges negated by the AC charge is less in the portion corresponding to the dark region of the image than in the portion corresponding to the light region of the image and ultimately, and the quantity of charges remaining in the portion corresponding to the dark region of the image becomes greater than the quantity of charges remaining in the portion corresponding to the light region of the image, whereby an electrostatic latent image (*e*) is formed.

In the station for simultaneous AC charging and exposure according to the present invention, the corona discharge current difference ΔI becomes constant independently of the light and dark regions of the image. However, by disposing the grid 16 adjacent to the photosensitive medium 1, it is possible in the step (*a*) to create a difference in the quantity of charges negated between the portions corresponding to the light and dark regions of the image.

By connecting the AC high voltage output having the controlled current difference ΔI to the corona wire of the charger and disposing the grid adjacent to the photosensitive medium 1 in the manner described above, it is possible to achieve the charging which is unaffected by the change in corona discharge resistance resulting from the change in atmospheric conditions such as temperature and humidity and the change in the distance between the corona discharge wire and the photosensitive medium 1, and accordingly to produce a stable electrostatic latent image.

If the voltage source of FIG. 8 is used with the present example, it becomes possible to effect the control of constant voltage and constant current difference by AC corona discharge, instead of the control of constant voltage and constant current which could not theoretically be realized by DC corona charging, and to obtain the effect of substantial coexistence of constant voltage and constant current, thereby producing a stable electrostatic latent image. If an insulative shield is employed in place of the conductive shield 18, the corona discharge current flowing outwardly may be eliminated so that the same effect can be obtained using a less output current.

In the foregoing, the grid bias may be changed by a self-bias comprising a grid grounded through a resistor or by changing the location of the grid.

According to the present invention, as has hitherto been described, the step of simultaneous or successive exposure and charging is effected by the AC corona discharge having a constant current difference maintained between the plus and the minus component and under the grid control of the charge application, whereby it is possible to realize an electrophotographic method capable of an electrostatic latent image which is stable against the change in corona discharge resistance resulting from the change in the distance between the corona discharge wire and the photosensitive medium and the change in atomspheric conditions such as temperature and humidity.

The present invention is not restricted to the socalled copying process which comprises illuminating an image original to form a latent image, but is equally applicable to the process which uses a light beam to form a latent image. It is also applicable to the process which lacks the primary charging step.

Where the photosensitive medium in use is of high memory capacity, the present invention permits the primary corona charging, the exposure and the secondary corona charging to take place in succession, and is particularly effective where the influence of the corona discharge resistance attributable to the light and dark of the exposure is left. Further, the present invention permits the primary charging, the secondary charging and the exposure to take place successively in the named order.

What we claim is:

1. An electrophotographic process wherein a grounded photosensitive member is charged and then exposed to image light to form an electrostatic image, and wherein a developed image corresponding to the latent image is formed on a transfer material, said process utilizing a plurality of corona dischargers including an AC corona discharger provided adjacent to said photosensitive member for performing different functions during the process, wherein the AC corona discharger and an image-light exposing means for imparting potential changes to the photosensitive member are operated simultaneously, comprising the steps of:

applying electric power to said AC corona discharger from a power source means including a DC power source and an AC power source connected thereto in series;

detecting, at a location between an end of said power source means and ground, the current difference between the positive and the negative current components of the AC current which flows between said power source means and ground; and controlling said DC power source in accordance with the detected current to maintain the current difference constant.

2. In a process according to claim 1, the additional steps of detecting the total positive and negative AC current components, and maintaining the total AC current constant in accordance with the detected current components.

3. In a process according to claim 1, the additional steps of detecting and maintaining the AC corona discharge voltage constant.

4. In an electrophotographic apparatus wherein a grounded photosensitive member is charged and then exposed to image light to form an electrostatic latent image, and wherein a developed image corresponding to the latent image is formed on a transfer material, the combination comprising:

a plurality of corona dischargers, including an AC corona discharger, provided adjacent to said photosensitive member for performing different functions, said AC corona discharger, and an image light exposing means operating simultaneously for imparting potential changes to the photosensitive member;

power source means, including a DC power source and an AC power source connected thereto in series, for applying electric power to said AC corona discharger;

means for detecting, at a location between an end of said power source means and ground, the current difference between the positive and negative current components of the AC current which flows between said power source means and ground;

and means for controlling said DC power source in accordance with the detected current to maintain the current difference constant.

5. A electrophotographic apparatus according to claim 4, wherein said corona discharge means includes a corona discharge wire surrounded by a shield electrically insulated from ground and having at least an open portion facing said photosensitive member.

6. An electrophotographic process in which a grounded photosensitive member is charged and then exposed to image light to form an electrostatic latent image, and in which a developed image corresponding to the latent image is formed on a transfer material, and a plurality of corona dischargers including an AC corona discharger provided with a grid are positioned adjacent to the photosensitive member for performing different functions during the process, wherein the AC corona discharger and an image light exposing means for imparting potential change to the photosensitive member are operated simultaneously, comprising the steps of:

applying electric power to said AC corona discharger from a power source means comprising a DC power source and an AC power source connected thereto in series;

detecting, at a location between an end of said power source means and ground, the current difference between the positive and negative current components of the AC current, including the current through the grid, which flows between said power source means and ground; and controlling said DC power source in accordance with the detected current to maintain the current difference constant.

7. In a process according to claim 6, the additional step of surrounding the corona discharge wire of the AC corona discharger with a shield having at least an open portion facing said photosensitive member so that any current flowing to ground is substantially eliminated by the shield.

8. In a process according to claim 6, the additional step of maintaining constant the voltage applied to the corona discharge wire of the AC corona discharger.

9. In an electrophotographic apparatus comprising a plurality of processes wherein a grounded photosensitive member is charged and then exposed to image light to form an electrostatic latent image, and wherein a developed image corresponding to the latent image is then formed on a transfer material, the combination comprising:

a plurality of corona dischargers, including an AC corona discharger provided with a grid, are provided adjacent to said photosensitive member for performing different functions, wherein said plurality of dischargers, including said AC corona discharger, and an image light exposing means for imparting potential changes to the photosensitive member are operated simultaneously;

power source means including a DC power source and an AC power source connected thereto in series, for applying power to said AC corona discharger;

means for detecting, at a location between an end of said power source means and ground, the current difference between the positive and negative current components of the AC current, including the current through said grid, which flows between said power source means and ground; and means for controlling said DC power source in accordance with the detected current to stably maintain the current difference constant.

10. In an electrophotographic process wherein a grounded phototsensitive member is charged by a DC corona discharger, then exposed to image light and simultaneously discharged by an AC corona discharger to form an electrostatic latent image, and then a developed image corresponding to the latent image is formed on a transfer material, the steps of:

applying electric power to said AC corona discharger from a power source means comprising a DC power source and an AC power source connected thereto in series;

detecting, at a location between an end of said power source means and ground, the current difference between the positive and negative current components of the AC current which flows between said power source means and ground; and controlling said DC power source in accordance with the detected current to maintain the current difference constant.

11. An electrophotographic process according to claim 10, wherein said AC corona discharge and said exposure to image light are effected successively.

12. An electrophotographic process according to claim 10, wherein said photosensitive member is charged under the charge application control of a grid disposed adjacent to the surface of said photosensitive member to thereby form an electrostatic latent image thereon.

13. An electrophotographic process according to claim 10, wherein said photosensitive member is precharged to either the positive or the negative polarity by said AC corona discharger, whereafter said photosensitive member is exposed to the image light to form an electrostatic latent image thereon, said electrostatic latent image is developed by means of toner and the toner image is transferred to a transfer material.

* * * * *

UNITED STATES PATENT AND TRADEMARK OFFICE

CERTIFICATE OF CORRECTION

PATENT NO. : 4,456,825

DATED : June 26, 1984

INVENTOR(S) : TSUKASA KUGE, ET AL.

It is certified that error appears in the above-identified patent and that said Letters Patent is hereby corrected as shown below:

COLUMN 1

Line 63, "this" should read --thus--.

COLUMN 3

Line 44, "at" should read --art--.

Line 53, "graph" should read --graphic--.

COLUMN 6

Line 6, delete "of".

COLUMN 7

Line 35, "after subjected" should read --after being subjected--.

COLUMN 8

Line 14, delete "is".

Line 15, after "advantage" insert --is--.

COLUMN 10

Line 18, "an" should read --a--.

COLUMN 12

Line 1, "different" should read --difference--.

UNITED STATES PATENT AND TRADEMARK OFFICE

CERTIFICATE OF CORRECTION

PATENT NO. : 4,456,825

DATED : June 26, 1984

INVENTOR(S) : TSUKASA KUGE, ET AL.

It is certified that error appears in the above-identified patent and that said Letters Patent is hereby corrected as shown below:

COLUMN 14

Line 13, "a" should read --an--.

COLUMN 20

Figure 28A:
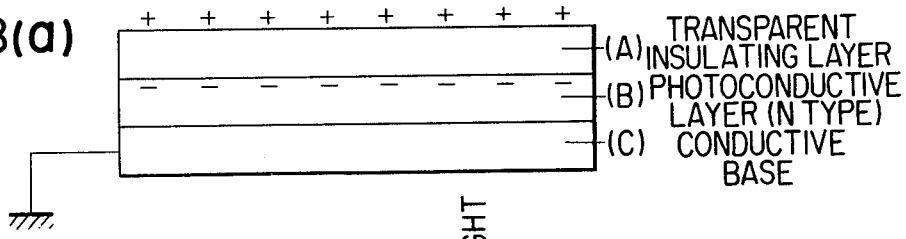
FIG. 28 is a schematic representation for illustrating the locations of charges in the photosensitive medium during the electrostatic latent image formation.
Figure 28B:
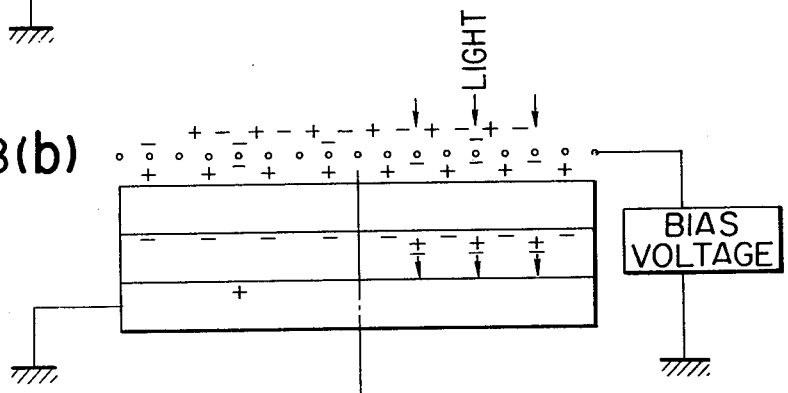
Figure 28C:
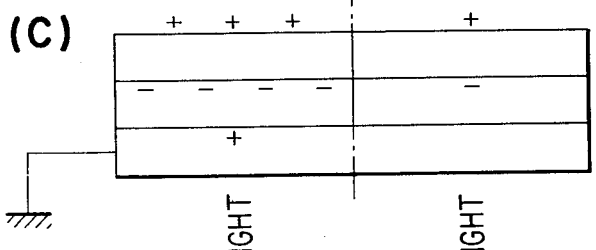
Figure 28D:
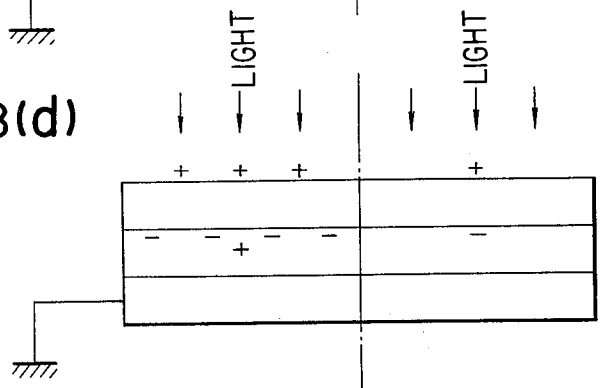
Figure 28E:
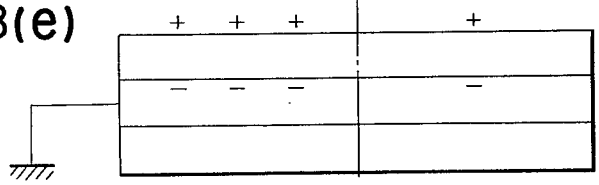

Line 26, Fig. 28(a)" should read --Fig. 28(b)--.

Line 30, delete ", and".

Line 67, delete "a".

COLUMN 21

Line 17, "socalled" should read --so-called--.

CLAIM 10

Line 1, "In an" should read --An--.

Line 7, after "material" insert --comprising--.

UNITED STATES PATENT AND TRADEMARK OFFICE

CERTIFICATE OF CORRECTION

PATENT NO. : 4,456,825

DATED : June 26, 1984

INVENTOR(S) : TSUKASA KUGE, ET AL.

It is certified that error appears in the above-identified patent and that said Letters Patent is hereby corrected as shown below:

CLAIM 13

Line 6, before "said" insert --and--.

Signed and Sealed this

*Nineteenth* Day of *March 1985*

[SEAL]

*Attest:*

DONALD J. QUIGG

*Attesting Officer* *Acting Commissioner of Patents and Trademarks*